US011480298B2

(12) United States Patent
Sassi et al.

(10) Patent No.: US 11,480,298 B2
(45) Date of Patent: Oct. 25, 2022

(54) SEALED AND THERMALLY INSULATING TANK WITH SEVERAL AREAS

(71) Applicant: GAZTRANSPORT ET TECHNIGAZ, Saint Remy les Chevreuse (FR)

(72) Inventors: Mohamed Sassi, Saint Remy les Chevreuse (FR); Gery Canler, Saint Remy les Chevreuse (FR); Cedric Morel, Saint Remy les Chevreuse (FR); Sebastien Delanoe, Saint Remy les Chevreuse (FR); Bruno Deletre, Saint Remy les Chevreuse (FR); Raphael Prunier, Saint Remy les Chevreuse (FR); Nicolas Sartre, Saint Remy les Chevreuse (FR)

(73) Assignee: GAZTRANSPORT ET TECHNIGAZ, Saint Remy les Chevreuse (FR)

( * ) Notice: Subject to any disclaimer, the term of this patent is extended or adjusted under 35 U.S.C. 154(b) by 198 days.

(21) Appl. No.: 16/754,516

(22) PCT Filed: Oct. 16, 2018

(86) PCT No.: PCT/FR2018/052561
§ 371 (c)(1),
(2) Date: Apr. 8, 2020

(87) PCT Pub. No.: WO2019/077253
PCT Pub. Date: Apr. 25, 2019

(65) Prior Publication Data

US 2020/0309322 A1 Oct. 1, 2020

(30) Foreign Application Priority Data

Oct. 20, 2017 (FR) ..... 1771108
Jun. 5, 2018 (FR) ..... 1854890

(51) Int. Cl.
*F17C 3/02* (2006.01)

(52) U.S. Cl.
CPC ..... *F17C 3/027* (2013.01); *F17C 2201/052* (2013.01); *F17C 2203/0333* (2013.01);
(Continued)

(58) Field of Classification Search
CPC ..... F17C 2201/052; F17C 2203/0333; F17C 2203/0358; F17C 2221/033;
(Continued)

(56) References Cited

U.S. PATENT DOCUMENTS 4,155,482 A * 5/1979 Swaney ..... F17C 13/001 52/406.1
2008/0127880 A1* 6/2008 Dhellemmes ..... B63B 25/16 114/74 A (Continued)

FOREIGN PATENT DOCUMENTS

FR 2683786 A1 5/1993
FR 2691520 A1 11/1993

(Continued)

OTHER PUBLICATIONS

International Search Report for corresponding PCT application No. PCT/FR2018/052561, dated Jan. 31, 2019.

*Primary Examiner* — Shawn M Braden
(74) *Attorney, Agent, or Firm* — Notaro, Michalos & Zaccaria P.C.

(57) ABSTRACT

A tank that has a tank wall having a secondary insulating barrier, a primary insulating barrier, a primary sealed membrane and a secondary sealed membrane, the tank wall having a first area in which the insulating modules include spacers extending in a thickness direction of the tank wall between a cover panel and a bottom panel of said insulating modules, a second area in which a cover panel of the insulating modules is kept at a distance from a bottom panel by a structural insulating foam, a transition area interposed between the first area and the second area, the transition area having a coefficient of thermal contraction and/or a modulus of elasticity in the thickness direction of the tank wall which is between that of the first area and that of the second area.

31 Claims, 8 Drawing Sheets

(52) U.S. Cl.
CPC ..... *F17C 2203/0358* (2013.01); *F17C 2221/033* (2013.01); *F17C 2223/0161* (2013.01); *F17C 2260/011* (2013.01); *F17C 2270/0107* (2013.01)

(58) Field of Classification Search
CPC ..... F17C 2223/0161; F17C 2260/011; F17C 2270/0107
See application file for complete search history.

(56) References Cited

U.S. PATENT DOCUMENTS

| | | | | |
|---|---|---|---|---|
| 2017/0276215 | A1* | 9/2017 | Zimmermann | F04D 25/163 |
| 2018/0180223 | A1* | 6/2018 | Boyeau | F04B 15/08 |
| 2019/0137036 | A1* | 5/2019 | Chopard | F17C 3/027 |

FOREIGN PATENT DOCUMENTS

| | | | |
|---|---|---|---|
| FR | 2798358 | A1 | 3/2001 |
| FR | 2813111 | A1 | 2/2002 |
| FR | 2867831 | A1 | 9/2005 |
| FR | 2877638 | A1 | 5/2006 |
| FR | 2877639 | A1 | 5/2006 |
| WO | 8909909 | A1 | 10/1989 |
| WO | 2013004943 | A1 | 1/2013 |
| WO | 2013017773 | A2 | 2/2013 |
| WO | 2013017781 | A1 | 2/2013 |
| WO | 2013124556 | A1 | 8/2013 |
| WO | 2014057221 | A2 | 4/2014 |
| WO | 2014096600 | A1 | 6/2014 |
| WO | 2014128381 | A1 | 8/2014 |
| WO | 2015001240 | A2 | 1/2015 |
| WO | 2015007974 | A2 | 1/2015 |
| WO | 2016046487 | A1 | 3/2016 |
| WO | 2016097578 | A2 | 6/2016 |
| WO | 2016166481 | A2 | 10/2016 |

* cited by examiner

SEALED AND THERMALLY INSULATING TANK WITH SEVERAL AREAS

TECHNICAL FIELD

The invention relates to the field of tanks, sealed and thermally insulating, with membranes, for the storage and/or transport of fluid, such as a cryogenic fluid.

Sealed and thermally insulating tanks with membranes are used in particular for the storage of liquefied natural gas (LNG), which is stored, at atmospheric pressure, at around −163° C. These tanks may be installed onshore or on a floating structure. In the case of a floating structure, the tank may be intended for the transport of liquefied natural gas or to receive liquefied natural gas serving as fuel for the propulsion of the floating structure.

PRIOR ART

Sealed and thermally insulating tanks for the storage of liquefied natural gas, integrated in a support structure, such as the double hull of a carrier intended for the transport of liquefied natural gas, are known in the prior art. Generally, such tanks have a multilayer structure comprising successively, in the thickness direction from the outside toward the inside of the tank, a secondary thermal insulation barrier secured to the support structure, a secondary sealing membrane resting against the secondary thermal insulation barrier, a primary thermal insulation barrier resting against the secondary sealing membrane and a primary sealing membrane resting against the primary thermal insulation barrier and intended to be in contact with the liquefied natural gas contained in the tank.

FR2867831 describes a sealed and thermally insulating tank comprising a thermal insulation barrier formed from juxtaposed insulating boxes. These boxes have a cover plate and a bottom plate kept at a distance by support spacer plates and sides of said boxes. These insulating boxes are filled with insulation lining and form a substantially flat support surface for supporting a sealed membrane of the tank. Such insulating boxes have significant resistance to stresses in the tank, but the support spacer plates and the sides of the boxes form areas of greater thermal conductivity, limiting the thermal insulation properties of said boxes.

WO2013124556 describes a sealed and thermally insulating tank in which a thermal insulation barrier is formed from a plurality of juxtaposed insulating blocks. These insulating blocks successively comprise, in a thickness direction of the tank wall, a bottom plate, a lower structural insulating foam, an intermediate plate, an upper structural insulating foam and a cover plate. In these insulating blocks, the plates are kept at a distance from one another in the thickness direction of the tank wall by the structural insulating foam.

SUMMARY

An idea forming the basis of the invention is to produce a sealed and thermally insulating tank by combining several types of insulation of different natures and/or structures while retaining a sealed membrane borne in a substantially uniform and continuous manner.

Thus, an idea forming the basis of the invention is to manage the phenomena of changes in thickness between areas of the tank having different behaviors. To this end, an idea forming the basis of the invention is to create a gentle transition between insulating modules of a first area exhibiting a first operational behavior in thickness and insulating modules of a second area exhibiting a second operational behavior in thickness when they are subjected to changes in pressure and/or temperature generating a thickness differential in the tank wall.

According to one embodiment, the invention provides a sealed and thermally insulating tank for storing a fluid, integrated in a support structure, in which a tank wall comprises, in a thickness direction:

a secondary thermally insulating barrier and a primary thermally insulating barrier made up of juxtaposed insulating modules, an insulating module comprising a cover panel, a bottom panel and an insulating lining interposed between the bottom panel and the cover panel, a primary sealed membrane resting on the primary thermally insulating barrier, and a secondary sealed membrane resting on the secondary thermally insulating barrier, the tank wall comprising, in a length direction:

- a first area in which the insulating modules include spacers extending in the thickness direction of the tank wall between the cover panel and the bottom panel of said insulating modules, said spacers being distributed over the surface of the cover panel and of the bottom panel in such a way that the bottom panel and the cover panel of said insulating modules are kept at a distance from one another by said spacers,
- a second area in which the insulating lining of the insulating modules comprises a structural insulating foam interposed between the cover panel and the bottom panel on the surface of the cover panel and of the bottom panel in such a way that the cover panel of said insulating modules is kept at a distance from the bottom panel by said structural insulating foam,
- a transition area interposed between the first area and the second area, in which the insulating modules are formed in such a way that the tank wall in said transition area has at least one parameter, chosen from the coefficient of thermal contraction and the modulus of elasticity in the thickness direction of the tank wall, the value of which lies between the value of said at least one parameter of the first area of the tank wall in the thickness direction of the tank wall and the value of said at least one parameter of the second area of the tank wall in the thickness direction of the tank wall.

An idea forming the basis of the invention is that the operational behavior of the tank wall in the thickness direction can be characterized essentially by two physical properties, namely the coefficient of thermal contraction, which qualifies the response of the tank wall to temperature variations, and the modulus of elasticity in the thickness direction, which qualifies the response of the tank wall to pressure.

According to one embodiment, the value of said at least one parameter in the thickness direction of the tank wall of the insulating modules of the first area is substantially determined by the value of said at least one parameter in said thickness direction of the spacers, the bottom panel and the cover panel. In other words, the operational behavior in contraction in thickness, determined by at least one parameter chosen from the coefficient of thermal contraction and the modulus of elasticity in thickness, of an insulating module comprising spacers distributed over the surface of the cover panel and of the bottom panel, is mainly determined by the operational behavior in contraction in thickness of the support spacers, the cover panels and the bottom panels.

According to one embodiment, the value of said at least one parameter in the thickness direction of the tank wall of the insulating modules of the second area is substantially determined by the value of said at least one parameter in said thickness direction of the structural insulating foam, the bottom panel and the cover panel. In other words, the operational behavior in contraction in thickness, determined by at least one parameter chosen from the coefficient of thermal contraction and the modulus of elasticity in thickness, of an insulating module comprising a structural insulating foam distributed over the surface of the cover panel and of the bottom panel, is mainly determined by the operational behavior in contraction in thickness of the structural insulating foam and the cover and bottom panels. Thus, properties such as the coefficient of thermal contraction and the modulus of elasticity in thickness are not the same for these various insulating modules.

The sealed and thermally insulating tank according to the invention advantageously makes it possible to limit the presence of steps between the thermally insulating barriers of said areas thanks to the presence of a transition area between the first area and the second area of the tank wall.

According to embodiments, such a tank may include one or more of the following features.

According to one embodiment, the insulating modules of the second area have a coefficient of thermal contraction in the direction of the thickness of the wall of the tank which is higher than the coefficient of thermal contraction of the insulating modules of the first area in the direction of the thickness of the wall of the tank.

According to one embodiment, the insulating modules of the transition area are formed in such a way that the tank wall in said transition area has a coefficient of thermal contraction in the thickness direction of the tank wall which is between the coefficient of thermal contraction of the first area of the tank wall in the thickness direction of the tank wall and the coefficient of thermal contraction of the second area of the tank wall in the thickness direction of the tank wall.

According to one embodiment, the insulating modules of the first area have a modulus of elasticity in the direction of the thickness of the wall of the tank which is higher than the modulus of elasticity of the insulating modules of the second area in the direction of the thickness of the wall of the tank.

According to one embodiment, the insulating modules of the transition area are formed in such a way that the tank wall in said transition area has a modulus of elasticity in the thickness direction of the tank wall which is between the modulus of elasticity of the first area of the tank wall in the thickness direction of the tank wall and the modulus of elasticity of the second area of the tank wall in the thickness direction of the tank wall.

According to one embodiment, the first area corresponds to an area of the tank wall that is highly stressed and the second area corresponds to an area of the tank wall that is less stressed. According to one embodiment, the first area of the tank wall is an area in which the sealed membrane or membranes are fixed relative to the support structure. According to one embodiment, the first area is an area of the tank wall in which at least one sealed membrane is anchored on the support structure. According to one embodiment, the first area is, for example, a corner area of the tank, a gas dome, a liquid dome or an area for attaching a support stand for a pump. According to one embodiment, the second area is located in a central portion of the tank wall.

Thanks to these features, the sealed and thermally insulating tank according to the invention advantageously makes it possible to have good stress resistance properties in highly stressed areas and good insulation properties.

According to embodiments, the spacers of the insulating modules of the first area may be produced in many ways.

According to one embodiment, the spacers of the insulating modules of the first area form sides of said insulating modules such that said insulating modules are boxes having one or more internal spaces delimited by the spacers, the bottom panel and the cover panel. According to one embodiment, the insulating lining is arranged in said internal space or spaces. According to one embodiment, the spacers of the insulating modules of the first area comprise support pillars arranged between the bottom panel and the cover panel. According to one embodiment, the spacers of the insulating modules of the first area comprise spacer plates extending between the bottom panel and the cover panel. According to one embodiment, the spacers comprise spacers as above in combination between the bottom panel and the cover panel of the modules.

According to one embodiment, the insulating lining of the insulating modules of the first area is a non-supporting or non-structural insulating lining such as perlite, glass wool, aerogels or the like, or even mixtures thereof.

According to one embodiment, the insulating lining arranged in the internal space or spaces of the boxes is a non-structural insulating lining such as perlite, glass wool, aerogels or the like, or even mixtures thereof.

According to one embodiment, the structural insulating foam is a polyurethane foam. According to one embodiment, this structural insulating foam is a high density foam, for example with a density greater than 100 kg/m$^3$, preferably greater than or equal to 120 kg/m$^3$, in particular equal to 210 kg/m$^3$.

According to one embodiment, the structural insulating foam is a reinforced foam, for example reinforced with fibers such as glass fibers.

According to one embodiment, the bottom panel is a plywood panel. According to one embodiment, the cover panel is a plywood panel.

According to one embodiment, the spacers also extend with a component in a plane perpendicular to the thickness direction of the tank wall, that is to say in an oblique direction relative to the thickness direction.

According to one embodiment, the first area is arranged over all or part of a periphery of the wall.

According to one embodiment, the insulating modules of the transition area comprise

- a first insulating module arranged in the secondary thermally insulating barrier, the first insulating module having a first value of said at least one parameter in the thickness direction of the tank wall, and
- a second insulating module arranged in the primary thermally insulating barrier, the second insulating module having a second value of said at least one parameter in the thickness direction of the tank wall, the first insulating module and the second insulating module being superposed in the direction of the thickness of the tank wall.

By virtue of these features, the tank is simple to produce. Indeed, the transition area may be made using standardized insulating modules which can be integrated in a simple way in the thermally insulating barriers. Moreover, the difference in value of said at least one parameter between the transition area and the first and second areas of the tank wall is simple to achieve, this difference in value of said at least one parameter resulting simply from the superposition of two different insulating modules. In particular, it is possible to superpose an insulating module of the first area and an insulating module of the second area to form the transition area.

According to one embodiment, the coefficient of thermal contraction of the first insulating module in the thickness direction of the tank wall is between the coefficient of thermal contraction in said thickness direction of the insulating modules of the secondary thermally insulating barrier of the first area and the coefficient of thermal contraction in said thickness direction of the insulating modules of the secondary thermally insulating barrier of the second area, inclusive.

According to one embodiment, the modulus of elasticity of the first insulating module in the thickness direction of the tank wall is between the modulus of elasticity in said thickness direction of the insulating modules of the secondary thermally insulating barrier of the first area and the modulus of elasticity in said thickness direction of the insulating modules of the secondary thermally insulating barrier of the second area, inclusive.

According to one embodiment, the coefficient of thermal contraction of the first insulating module in said thickness direction is equal to the coefficient of thermal contraction in said thickness direction of the insulating modules of the first area.

According to one embodiment, the modulus of elasticity of the first insulating module in said thickness direction is equal to the modulus of elasticity in said thickness direction of the insulating modules of the first area.

According to one embodiment, the coefficient of thermal contraction in said thickness direction of the first insulating module is higher than the coefficient of thermal contraction in said thickness direction of the insulating modules of the first area.

According to one embodiment, the modulus of elasticity in said thickness direction of the first insulating module is lower than the modulus of elasticity in said thickness direction of the insulating modules of the first area.

According to one embodiment, the coefficient of thermal contraction of the second insulating module in the thickness direction of the tank wall is between the coefficient of thermal contraction in said thickness direction of the insulating modules of the primary thermally insulating barrier of the first area and the coefficient of thermal contraction in said thickness direction of the insulating modules of the primary thermally insulating barrier of the second area, inclusive.

According to one embodiment, the modulus of elasticity of the second insulating module in the thickness direction of the tank wall is between the modulus of elasticity in said thickness direction of the insulating modules of the primary thermally insulating barrier of the first area and the modulus of elasticity in said thickness direction of the insulating modules of the primary thermally insulating barrier of the second area, inclusive.

According to one embodiment, the coefficient of thermal contraction of the second insulating module in said thickness direction is equal to the coefficient of thermal contraction in said thickness direction of the insulating modules of the second area.

According to one embodiment, the modulus of elasticity of the second insulating module in said thickness direction is equal to the modulus of elasticity in said thickness direction of the insulating modules of the second area.

According to one embodiment, the coefficient of thermal contraction in said thickness direction of the second insulating module is lower than the coefficient of thermal contraction in said thickness direction of the insulating modules of the second area.

According to one embodiment, the modulus of elasticity in said thickness direction of the second insulating module is higher than the modulus of elasticity in said thickness direction of the insulating modules of the second area.

According to one embodiment, the coefficient of thermal contraction in the thickness direction of the tank wall of the first insulating module is lower than the coefficient of thermal contraction in said thickness direction of the second insulating module.

According to one embodiment, the modulus of elasticity in the thickness direction of the tank wall of the first insulating module is higher than the modulus of elasticity in said thickness direction of the second insulating module.

According to one embodiment:

one out of the first insulating module and the second insulating module comprises spacers extending in a thickness direction of the tank wall between the cover panel and the bottom panel of said insulating module, said spacers being distributed over the surface of the bottom panel and of the cover panel in such a way that the bottom panel and the cover panel of said insulating module are kept at a distance from one another by said spacers, and the other out of the first insulating module and the second insulating module comprises a structural insulating foam interposed between the cover panel and the bottom panel on the surface of the cover panel and of the bottom panel in such a way that the cover panel of said other insulating module is kept at a distance from the bottom panel of said other insulating module by said structural insulating foam.

By virtue of these features, the insulating modules of the transition area have structures similar to the insulating modules of the first and second areas. Thus, the insulating modules of the transition area are simple to manufacture and do not require the use of insulating modules having a structure that is different to the structures of the other areas of the tank wall. The insulating modules used to manufacture the tank wall can thus be standardized for the various areas of the tank wall.

According to one embodiment, the first insulating module is identical to the insulating modules of the second area, for example identical to the insulating modules of the primary thermally insulating barrier or of the secondary thermally insulating barrier of the second area of the tank wall.

According to one embodiment, the second module is identical to the insulating modules of the first area, for example identical to the insulating modules of the primary thermally insulating barrier or of the secondary thermally insulating barrier of the first area of the tank wall.

According to one embodiment, said other out of the first insulating module and the second insulating module extends jointly in the transition area and in the second area of the tank wall.

According to one embodiment, said other out of the first insulating module and the second insulating module is an insulating module of the primary thermally insulating barrier. In other words, said other out of the first insulating module and the second insulating module is the second insulating module.

According to one embodiment, said one out of the first insulating module and the second insulating module extends jointly in the transition area and in the first area of the tank wall.

According to one embodiment, said one out of the first insulating module and the second insulating module is an insulating module of the secondary thermally insulating barrier. In other words, said one out of the first insulating module and the second insulating module is the first insulating module.

According to one embodiment, the value of said at least one parameter of the other out of the first insulating module and the second insulating module is lower than the value of said at least one parameter of the one out of the first insulating module and the second insulating module.

According to one embodiment, the first area corresponds to a corner area of the tank comprising a connection ring, and the transition area is directly adjacent to the connection ring, and in which the second insulating module comprises a structural insulating foam interposed between the cover panel and the bottom panel on the surface of the cover panel and of the bottom panel in such a way that the cover panel of said other insulating module is kept at a distance from the bottom panel of said other insulating module by said structural insulating foam.

According to one embodiment, the first insulating module comprises spacers extending in a thickness direction of the tank wall between the cover panel and the bottom panel of said insulating module, said spacers being distributed over the surface of the bottom panel and of the cover panel in such a way that the bottom panel and the cover panel of said insulating module are kept at a distance from one another by said spacers.

According to one embodiment, the insulating modules of the transition area comprise:

a third insulating module arranged in the secondary thermally insulating barrier, the third insulating module being closer to the second area than the first insulating module and having a third value of said at least one parameter in the thickness direction of the tank wall, a fourth insulating module arranged in the primary thermally insulating barrier, the fourth insulating module being closer to the second area than the second insulating module and having a fourth value of said at least one parameter in the thickness direction of the tank wall, and in which the third value of said at least one parameter of the third insulating module is between the first value of said at least one parameter of the first insulating module and the second value of said at least one parameter of the second insulating module.

According to one embodiment, the third insulating module is a mixed module comprising an intermediate panel arranged between the bottom panel and the cover panel, the insulating lining comprising a lower lining arranged between the intermediate panel and the bottom panel and an upper lining arranged between the intermediate panel and the cover panel, the mixed module having a coefficient of thermal expansion which is between the coefficient of thermal expansion of an insulating module of the first area and the coefficient of thermal expansion of an insulating module of the second area.

According to one embodiment, the fourth insulating module is identical to the second insulating module, such that the fourth value of said at least one parameter is equal to the second value of said at least one parameter.

According to one embodiment, the insulating modules of the transition area comprise a third insulating module arranged in the secondary thermally insulating barrier, the third insulating module being closer to the second area than the first insulating module and having a third value of said at least one parameter in the thickness direction of the tank wall, and in which the second insulating module extends over the entire length of the transition area in the primary thermally insulating barrier, the third value of said at least one parameter of the third insulating module being between the first value of said at least one parameter of the first insulating module and the second value of said at least one parameter of the second insulating module.

According to one embodiment, the transition area has a coefficient of thermal contraction in the thickness direction of the tank wall increasing in the length direction of the tank wall from the first area toward the second area of the tank wall.

According to one embodiment, the transition area has a modulus of elasticity in the thickness direction of the tank wall decreasing in the length direction of the tank wall from the first area toward the second area of the tank wall.

According to one embodiment, the primary thermally insulating barrier and the secondary thermally insulating barrier comprise a plurality of insulating modules in the transition area.

According to one embodiment, the insulating modules of the primary thermally insulating barrier and/or of the secondary thermally insulating barrier located in the transition area have different coefficients of thermal contraction in the thickness direction of the tank wall.

According to one embodiment, the insulating modules of the primary thermally insulating barrier and/or of the secondary thermally insulating barrier located in the transition area have different moduli of elasticity in the thickness direction of the tank wall.

According to one embodiment, an insulating module located in the transition area close to the first area has a coefficient of thermal contraction in said thickness direction which is lower than the coefficient of thermal contraction in said thickness direction of an insulating module located in the transition area in the same thermally insulating barrier and further away from the first area.

According to one embodiment, an insulating module located in the transition area close to the first area has a modulus of elasticity in said thickness direction which is higher than the modulus of elasticity in said thickness direction of an insulating module located in the transition area in the same thermally insulating barrier and further away from the first area.

By virtue of these features, the transition area subdivides, into a plurality of small steps, the disparity generated by the difference in behavior between the insulating modules of the first area and the insulating modules of the second area. Such a subdivision makes it possible to provide a support surface for the sealed membranes having a satisfactory flatness. In particular, the disparity between the first area and the second area is subdivided into a plurality of steps of small amplitude, such steps of small amplitude not being detrimental to the performance and the service life of the sealed membranes. Furthermore, such a transition area using different insulating modules to produce a gentle slope is simple to produce.

According to one embodiment, the coefficient of thermal contraction in the thickness direction of the tank wall in the transition area increases continuously and gradually from the first area toward the second area.

According to one embodiment, the modulus of elasticity in the thickness direction of the tank wall in the transition area decreases continuously and gradually from the first area toward the second area.

According to one embodiment, an insulating module of the transition area comprises a structural insulating foam interposed between the cover panel and the bottom panel on the surface of the cover panel and of the bottom panel of said insulating module in such a way that the cover panel of said insulating module is kept at a distance from the bottom panel of said insulating module by said structural insulating foam, said structural insulating foam having a coefficient of thermal contraction in the thickness direction of the tank wall which is lower than the coefficient of thermal contraction in said thickness direction of the structural insulating foam of the second area.

According to one embodiment, the structural insulating foam of said insulating module of the transition area comprises a first portion of structural insulating foam and a second portion of structural insulating foam, the first portion of structural insulating foam being closer to the first area than the second portion of structural foam, the first portion of structural insulating foam having a coefficient of thermal contraction in the thickness direction of the tank which is lower than the coefficient of thermal contraction of the second portion of structural insulating foam in said thickness direction.

According to one embodiment, an insulating module of the transition area comprises a structural insulating foam interposed between the cover panel and the bottom panel on the surface of the cover panel and of the bottom panel of said insulating module in such a way that the cover panel of said insulating module is kept at a distance from the bottom panel of said insulating module by said structural insulating foam, said structural insulating foam having a modulus of elasticity in the thickness direction of the tank wall which is higher than the modulus of elasticity in said thickness direction of the structural insulating foam of the second area.

According to one embodiment, the structural insulating foam of said insulating module of the transition area comprises a first portion of structural insulating foam and a second portion of structural insulating foam, the first portion of structural insulating foam being closer to the first area than the second portion of structural foam, the first portion of structural insulating foam having a modulus of elasticity in the thickness direction of the tank which is higher than the modulus of elasticity of the second portion of structural insulating foam in said thickness direction.

Such a module is simple to produce because it uses materials of the same nature to generate a gradual change in the coefficient of thermal contraction and/or in the modulus of elasticity in the thickness direction of the tank wall.

According to one embodiment, the structural insulating foam of said module is a fiber-reinforced polyurethane foam, the first portion of structural insulating foam having the fibers oriented in a thickness direction of the tank wall and the second portion of structural insulating foam having the fibers oriented perpendicular to the thickness direction of the tank wall.

According to one embodiment, the thickness of the first portion gradually decreases from the first area toward the second area and the thickness of the second portion gradually increases from the first area toward the second area.

According to one embodiment, the insulating modules of the transition area comprise a mixed module comprising an intermediate panel arranged between the bottom panel and the cover panel, the insulating lining comprising a lower lining arranged between the intermediate panel and the bottom panel and an upper lining arranged between the intermediate panel and the cover panel.

According to one embodiment, the first insulating module is a mixed module.

According to one embodiment, the mixed module comprises support spacers extending in a thickness direction of the tank wall between the intermediate panel and one out of the bottom panel and the cover panel, said spacers being distributed over the surface of the intermediate panel and of said one out of the bottom panel and the cover panel in such a way that the intermediate panel and said one out of the bottom panel and the cover panel are kept at a distance from one another by said support spacers.

According to one embodiment, the insulating lining arranged between the intermediate panel and the other out of the bottom panel and the cover panel comprises a structural insulating foam distributed over the surface of the intermediate panel and of said other out of the bottom panel and the cover panel in such a way that the intermediate panel and said other out of the bottom panel and the cover panel are kept at a distance by said structural insulating foam.

According to one embodiment, the intermediate panel extends in a plane which is inclined relative to the bottom panel and to the cover panel. Thus, the coefficient of thermal contraction of the mixed module gradually increases in the length direction of the tank wall from the first area of the tank wall toward the second area of the tank wall and/or the modulus of elasticity of the mixed module gradually decreases in the length direction of the tank wall from the first area of the tank wall toward the second area of the tank wall.

Thus, the mixed module has a coefficient of thermal contraction in the thickness direction of the tank wall gradually increasing from the first area toward the second area of the tank wall and/or a modulus of elasticity in the thickness direction of the tank wall gradually decreasing from the first area toward the second area of the tank wall.

According to one embodiment, the intermediate panel is at a distance from an edge of the mixed module located close to one out of the first area and the second area.

According to one embodiment, the intermediate panel is at a distance from one out of the bottom panel and the cover panel of the mixed module.

According to one embodiment, the primary and secondary sealed membranes are made up essentially of metal strips extending in the length direction and having raised longitudinal edges, the raised edges of two adjacent metal strips being welded in pairs so as to form expansion bellows allowing deformation of the sealed membrane in a direction perpendicular to the length direction. According to one embodiment, the primary and/or secondary sealing membranes include corrugated metal plates.

According to one embodiment, the corner of the tank comprises a primary anchoring wing and a secondary anchoring wing, a first end of said anchoring wings being anchored to the support structure and a second end of said anchoring wings being leaktightly welded to the corresponding sealing membrane.

According to one embodiment, the primary sealing membrane comprises corrugations extending perpendicular to the raised edges and arranged in line with the first area.

According to one embodiment, the secondary sealed membrane is made up essentially of metal strips extending in the length direction and having raised longitudinal edges, the raised edges of two adjacent metal strips being welded in pairs so as to form expansion bellows allowing deformation of the sealed membrane in a direction perpendicular to the length direction, in which the corner of the tank comprises a secondary anchoring wing, a first end of said anchoring wing being anchored to the support structure and a second end of said anchoring wing being leaktightly welded to the secondary sealing membrane, and in which the primary sealed membrane comprises corrugated metal plates.

Such a tank may form part of an onshore storage facility, for example for storing LNG, or be installed in a floating structure, coastal or deep-water, in particular an LNG carrier, a floating storage and regasification unit (FSRU), a remote floating production and storage unit (FPSO), and the like.

According to one embodiment, the invention also provides a carrier for the transport of a cold liquid product comprising a double hull and a tank as described above arranged in the double hull.

According to one embodiment, the invention also provides a method for loading or unloading such a carrier, in which a cold liquid product is conveyed through insulated pipelines from or to a floating or onshore storage facility, to or from the tank of the carrier.

According to one embodiment, the invention also provides a transfer system for a cold liquid product, the system comprising the abovementioned carrier, insulated pipelines arranged so as to connect the tank installed in the hull of the carrier to a floating or onshore storage facility, and a pump for pumping a flow of cold liquid product through the insulated pipelines from or to the floating or onshore storage facility, to or from the tank of the carrier.

According to one embodiment, the invention also provides an insulating module comprising a cover panel, a bottom panel and an insulating lining interposed between the bottom panel and the cover panel, said insulating module further comprising an intermediate panel arranged between the bottom panel and the cover panel and separating the insulating module into an upper part and a lower part, the insulating lining comprising a lower lining arranged between the intermediate panel and the bottom panel and an upper lining arranged between the intermediate panel and the cover panel, said insulating module having at least one parameter chosen from the coefficient of thermal contraction and the modulus of elasticity in the thickness direction of the tank wall, the value of which is different between the upper part of the insulating module and the lower part of the insulating module.

According to one embodiment, said insulating module comprises support spacers extending in a thickness direction of the tank wall between the intermediate panel and at least one out of the bottom panel and the cover panel, said spacers being distributed over the surface of the intermediate panel and of said at least one out of the bottom panel and the cover panel in such a way that the intermediate panel and said at least one out of the bottom panel and the cover panel are kept at a distance from one another by said support spacers.

According to one embodiment, the insulating lining arranged between the intermediate panel and at least one out of the bottom panel and the cover panel comprises a structural insulating foam distributed over the surface of the intermediate panel and of said at least one out of the bottom panel and the cover panel in such a way that the intermediate panel and said at least one out of the bottom panel and the cover panel are kept at a distance by said structural insulating foam.

According to one embodiment, the intermediate panel extends in a plane which is inclined relative to the bottom panel and to the cover panel.

According to one embodiment, one out of the upper lining and the lower lining is a fiber-reinforced polyurethane foam having the fibers oriented in a thickness direction of the tank wall and the other out of the lower lining and the upper lining is a fiber-reinforced polyurethane foam having the fibers oriented perpendicular to the thickness direction of the tank wall.

According to one embodiment, the inclined intermediate panel is at a distance from an edge of the insulating module such that the lower lining or the upper lining forms the entire thickness of the insulating lining of the insulating module at said edge. This embodiment makes it possible to produce said edge with a high resistance, avoiding the presence of a layer of lower lining or upper lining of small thickness which could deteriorate.

According to one embodiment, the side of the inclined intermediate panel closest to the bottom panel is at a distance from the bottom panel. Thus, the insulating lining is formed only of the lower lining at the bottom panel, thus offering a uniform structure advantageously affording good mechanical strength, for example for the attachment of an element of an anchoring member on the bottom panel of the insulating module.

BRIEF DESCRIPTION OF THE FIGURES

The invention will be better understood, and other objects, details, features and advantages thereof will appear more clearly during the following description of several particular embodiments of the invention, provided solely by way of non-limiting illustration, with reference to the attached drawings.

DETAILED DESCRIPTION OF EMBODIMENTS

Figure 1:
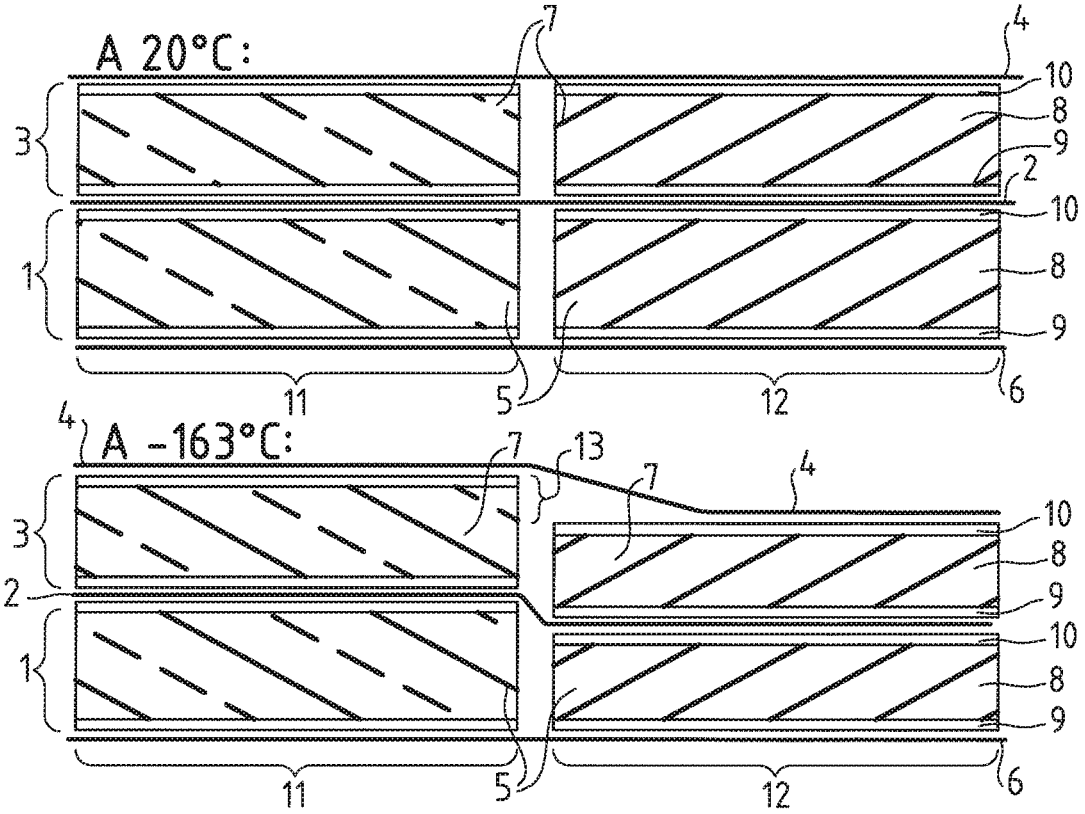
FIG. 1 depicts, very schematically, a sealed and thermally insulating tank wall comprising two structurally different areas in two different tank loading states, empty at ambient temperature of 20° C. and filled with LNG at −163° C.

With reference to FIG. 1, a sealed and thermally insulating tank wall will be described according to an embodiment that will help explain the invention.

A sealed and thermally insulating tank for the transport of LNG comprises a plurality of tank walls defining an internal space intended for the storage of LNG. Each tank wall comprises, from the outside toward the inside of the tank, a secondary thermal insulation barrier 1, a secondary sealing membrane 2, a primary thermal insulation barrier 3 and a primary sealing membrane 4 intended to be in contact with a cryogenic fluid contained in the tank.

The secondary thermal insulation barrier 1, hereinafter secondary insulating barrier 1, comprises secondary insulating blocks 5. These secondary insulating blocks are juxtaposed and anchored to a support structure 6 by secondary securing members, for example studs or couplers welded to the support structure 6. These secondary insulating blocks 5 form a secondary support surface on which the secondary sealing membrane 2 is secured.

Likewise, the primary thermally insulating barrier 3, hereinafter primary insulating barrier 3, comprises primary insulating blocks 7. These primary insulating blocks 7 are juxtaposed and secured on the secondary sealing membrane 2 by primary securing members. These primary insulating blocks 7 form a primary support surface on which the primary sealing membrane 4 is secured.

The support structure 6 may in particular be a self-supporting metal sheet or, more generally, any type of rigid partition having suitable mechanical properties. The support structure 6 may in particular be formed by the hull or the double hull of a carrier. The support structure 6 comprises a plurality of walls defining the general shape of the tank, usually a polyhedral shape.

The secondary 5 and primary 7 insulating blocks have substantially the shape of a rectangular parallelepiped. These secondary 5 and primary 7 insulating blocks each comprise a layer of insulating lining 8 interposed between a bottom plate 9 and a cover plate 10.

FIG. 1 shows the behavior of two areas of a tank wall comprising insulating blocks 5, 7 having different structures. In this FIG. 1, a first area 11 and a second area 12 of the sealed and thermally insulating tank wall are shown schematically.

The first area 11 of the tank wall, shown on the right-hand side of FIG. 1, represents an area of the tank wall subjected to high stresses in the tank. The second area 12 of the tank wall, shown on the left-hand side of FIG. 1, represents an area of the tank wall subjected to less stress in the tank.

In the rest of the description, the first area 11 comprises insulating blocks 5, 7 having good stress resistance and the second area 12 comprises insulating blocks 5, 7 having a lower stress resistance but better thermal insulation properties.

The insulating blocks 5, 7 of the first area 11 comprise spacers extending in the thickness direction of the tank wall between the cover plate 10 and the bottom plate 9 of said insulating blocks 5, 7. These spacers are distributed over the surface of the cover plate 10 and of the bottom plate 9 in such a way that the bottom plate 9 and the cover plate 10 of said insulating blocks 5, 7 are kept at a distance from one another by said spacers. Preferably, these spacers are distributed over the entire surface of the cover plate 10 and of the bottom plate 9. Owing to the presence of the spacers and their distributed arrangement between the bottom plate 9 and the cover plate 10, the mechanical strength in the thickness direction of the insulating blocks 5, 7 of the first area is mainly determined by the spacers. According to the same principle, the behavior of the insulating blocks 5, 7 of the first area in the thickness direction is mainly determined by the coefficient of thermal contraction of the spacers, which is of the order of 4 to $10\times10^{-6}$ $K^{-1}$ when the spacers are made of plywood. In other words, the insulating lining 8 has little or no role in keeping the bottom and cover plates at a distance. Such an insulating lining 8 is for example glass wool, perlite, or even low density polymer foam, for example having a density between 30 and 40 $kg/m^3$.

Such insulating blocks 5, 7 of the first area 11 may be produced in many ways. In particular, the spacers may take many forms such as for example the form of spacer plates, support pillars, lateral sides of the insulating blocks 5, 7, etc.

For example, the insulating blocks 5, 7 of the first area may be produced in the form of boxes having lateral edges and support spacer plates between the bottom plates 9 and the cover plates 10. The insulating lining 8 of such blocks is housed in internal spaces delimited by the lateral edges and the support spacers between the bottom plate and the cover plate. FR2798358, FR2867831, FR2877639 and FR2683786 describe embodiments of such insulating blocks 5, 7 of the first area in the form of boxes.

Likewise, the insulating blocks 5, 7 of the first area may include support pillars, the bottom plate 9 and the cover plate 10 being kept at a distance by these support pillars extending in the thickness direction of said insulating blocks. Such support pillars are in a distributed arrangement between the bottom plate 9 and the cover plate 10 in order to ensure uniform spacing between the bottom and cover plates. Embodiments of such blocks comprising support pillars are for example described in WO2016097578, FR2877638 and WO2013017773.

The insulating blocks 5, 7 of the second area 12 comprise an insulating lining 8 in the form of structural insulating foam interposed between the cover plate 10 and the bottom plate 9 on the surface of the cover plate 10 and of the bottom plate 9. Preferably, this structural insulating foam is interposed between the cover plate 10 and the bottom plate 9 over substantially the entire surface of the cover plate 10 and of the bottom plate 9. Thus, the cover plate 10 of said insulating blocks 5, 7 of the second area 12 is kept at a distance from the bottom plate 9 by said structural insulating foam. Such a structural insulating foam has, in the direction of the thickness of the wall of the tank, a coefficient of thermal contraction which is higher than the coefficient of thermal contraction of the spacers in said direction of the thickness of the wall of the tank. Similarly, such a structural insulating foam has, in the direction of the thickness of the wall of the tank, a modulus of elasticity which is lower than the modulus of elasticity of the spacers in said direction of the thickness of the wall of the tank.

Such a structural insulating foam may take many forms, this structural insulating foam having the function, in addition to its thermal insulation function, of keeping the bottom plates 9 and cover plates 10 at a distance. Thus, the mechanical strength in the thickness direction of the insulating blocks 5, 7 of the second area 12 is mainly determined by the characteristics of the structural insulating foam. Insulating blocks 5, 7 comprising such a structural insulating foam may take many forms.

For example, such blocks 5, 7 of the second area may comprise a polyurethane foam structurally capable of keeping the bottom plate and the cover plate at a distance. The structural insulating foam is for example a polyurethane foam reinforced with glass or aramid fiber having a density of 120 to 140 kg/m$^3$. The structural insulating foam may also be a high density reinforced polyurethane foam having a density greater than or equal to 170 kg/m$^3$, preferably equal to 210 kg/m$^3$. Such insulating blocks 5, 7 are for example described in FR2813111. Likewise, WO2013124556 and WO2013017781 describe insulating blocks 5, 7 comprising a layer of structural insulating foam interposed between and keeping at a distance a bottom plate and a cover plate.

The insulating blocks 5, 7 of the second area 12 may have sporadic reinforcement areas. However, with the exception of these sporadic reinforcement areas, the bottom and cover plates of the insulating blocks in these documents are kept at a distance mainly by the structural insulating foam. For example, the insulating blocks 5, 7 of the second area 12 may include corner pillars for reinforcing the anchoring areas of the insulating block 5, 7. However, these corner pillars constitute individual sporadic areas, the bottom plate 9 and the cover plate 10 being mainly kept at a distance by the structural insulating foam. WO2013017781 describes an exemplary embodiment of such insulating blocks 5, 7 of the second area 12 comprising corner pillars.

The documents mentioned above also give other details on the manufacture of sealed and thermally insulating tanks, in particular on the secondary 2 and primary 4 sealing membranes, the anchoring members of the insulating barriers 1, 3. Other possible exemplary embodiments of the sealing membranes, based on corrugated metal sheets, are also described in WO2016/046487, WO2013004943 or WO2014057221.

The insulating blocks 5, 7 of the first area 11 have good stress resistance characteristics owing to the spacers. However, these spacers also constitute locations of greater thermal conductivity between the bottom plate 9 and the cover plate 10.

Conversely, the insulating blocks 5, 7 of the second area 12 have good thermal insulation properties, better than those of the first area 11. However, these insulating blocks 5, 7 of the second area 12 have a lower stress resistance than the insulating blocks 5, 7 of the first area 11.

Preferably, the first area 11 is adjacent to a corner of the tank and the second area 12 is arranged in the central part of the wall. To be specific, the insulating blocks in the tank are subjected to different stresses depending on their location. In particular, the insulating blocks arranged in the corner areas of the tank, namely the first area 11, are generally subjected to higher stresses than the insulating blocks located in the flat areas of the tank, namely the second area 12.

In an embodiment which is not shown, the first area 11 may be adjacent to a portion of the tank wall where the sealing membranes must be interrupted, for example a portion of the tank wall through which a pipeline, in particular a gas dome pipeline, passes, a portion of the tank wall through which a support stand, for example for a pump, passes, or a portion of the tank wall at the end of a liquid dome. Portions of the tank wall through which a pipeline or a support stand for a pump passes are described, for example, in WO2014128381. To be specific, in these particular areas of the tank, the insulating blocks may also be subjected to high stresses.

By virtue of the arrangement of FIG. 1, the type of insulating blocks has been adapted to the areas of the tank in which said insulating blocks are arranged, and more particularly to the stresses to which said insulating blocks must be subjected in these areas. Such an arrangement of the insulating blocks in the tank makes it possible to obtain a tank which is optimized both from a thermal insulation point of view and from a stress resistance point of view.

However, the use of insulating blocks having different structures and materials leads to operational differences in the functioning of said insulating blocks, in particular as regards compression, creep, dimensional disparity in terms of thickness of the insulating blocks, under the effect of thermal changes, hydrostatic and hydrodynamic pressure in the tank, etc.

The upper part of FIG. 1 shows these two areas 11, 12 in the context of an empty tank at ambient temperature, for example 20° C. The lower part of FIG. 1 shows these two areas 11, 12 in the context of a tank full of LNG at −163° C.

The first area 11 and the second area 12 have an identical thickness at ambient temperature in order to provide a flat support surface for the sealing membranes 2, 4.

In the rest of the description, the expression "coefficient of thermal contraction" is used with reference to the coefficient of thermal contraction of an element in the thickness direction of the tank wall.

Due to the different structure of the insulating blocks 5, 7, the first area 11 and the second area 12 have different coefficients of thermal contraction, different stiffnesses, different creep strengths, etc. In other words, the first area 11 and the second area 12 behave differently under thermal loads, cargo, sloshing, etc.

Consequently, the first area 11 and the second area 12 have different changes in thickness when the tank is filled with LNG. Thus, if the first area 11 and the second area 12 have an identical thickness when the tank is empty, as shown in the upper part of FIG. 1, a step 13 in the thickness direction of the tank wall appears between the first area 11 and the second area 12 when the tank is filled with LNG, as shown in the lower part of FIG. 1. This step 13 is particularly large at the primary support surface supporting the primary sealing membrane 4 because this step 13 is generated by the thickness change differential between the two insulating barriers 1 and 3. For example, in the case of a first area comprising insulating blocks in the form of plywood boxes and a second area comprising insulating blocks made of structural foam, a primary insulating barrier 3 which is 230 mm thick and a secondary insulating barrier 1 which is 300 mm thick, there may be a step 13 of up to around 8 to 12 mm mainly under the joint effects of sloshing and thermal contraction, accounting for two thirds, and to a lesser extent under the combined effect of cargo pressure and creep.

However, the sealing membranes 2, 4 function optimally in a flat geometry and may exhibit weaknesses in the event of excessive steps. This is why the thermally insulating barriers of the prior art use insulating blocks having similar structures over the entire surface of the tank walls. This problem is found in particular with sealed membranes made of strips of Invar with raised edges, although it also arises to a lesser extent with sealed membranes made of corrugated metal sheets.

Figure 2:
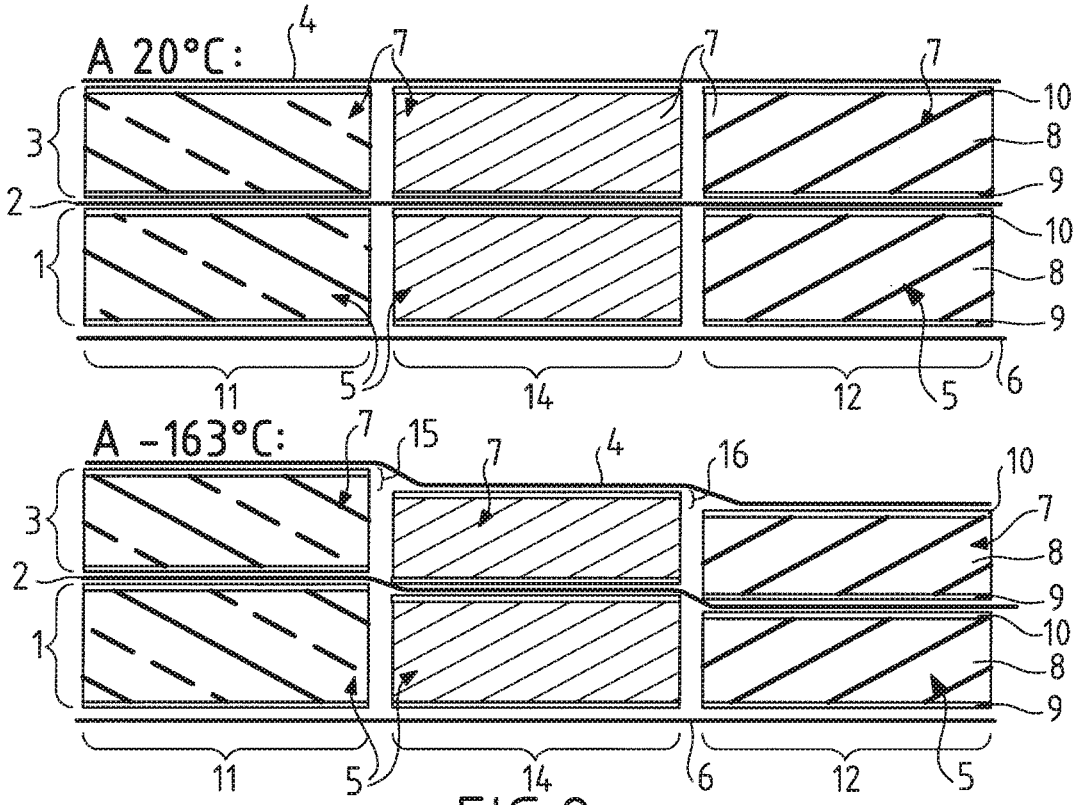
FIG. 2 schematically depicts a sealed and thermally insulating tank wall according to an embodiment of the invention comprising two structurally different areas between which is arranged a transition area, in two tank loading states, empty at ambient temperature of 20° C. and filled with LNG at −163° C.

FIG. 2 is a schematic depiction illustrating the principle of a tank wall in which the thermally insulating barriers 1, 3 comprise insulating blocks 5, 7 arranged according to the stresses experienced in the tank while presenting a support surface suitable for supporting the sealing membranes 2, 4. Numerous embodiments are described in more depth below with reference to FIGS. 3 to 17 in order to implement such a tank wall.

The tank wall shown in FIG. 2 includes, in a manner similar to the tank wall described with reference to FIG. 1, a first area 11 and a second area 12 comprising insulating blocks 5, 7 having different structures. The tank wall also includes a transition area 14 interposed between the first area 11 and the second area 12. This transition area 14 comprises insulating blocks 5, 7 selected such that said transition area 14 exhibits an intermediate behavior in compression, between the behavior in compression of the first area 11 and the behavior in compression of the second area 12.

As shown in the upper part of FIG. 2, the insulating blocks 5, 7 of the transition area 14 are selected to be flush with the insulating blocks 5, 7 of the first and second areas 11, 12 when the tank is empty at ambient temperature, so as to provide a flat support surface for the sealing membranes. However, the insulating blocks 5, 7 of the transition area 14 are also selected such that the transition area 14 has a thickness between the thickness of the first area 11 and the thickness of the second area 12 when the tank is full of LNG, as shown in the lower part of FIG. 2.

According to a preferred embodiment, the insulating blocks 5, 7 of the transition area 14 are selected such that the coefficient of thermal contraction of the transition area 14 is between the coefficient of thermal contraction of the first area 11 and the coefficient of thermal contraction of the second area 12.

The insulating blocks 5, 7 of the transition area 14 may also be selected according to other characteristics. Thus, the insulating blocks 5, 7 of the transition area 14 may be selected according to their stiffness at impact, for example to take into account the effects of sloshing of the liquid contained in the tank. These insulating blocks 5, 7 of the transition area 14 may also be selected according to their stiffness in static compression to take into account the pressure linked to the weight of the liquid contained in the tank. Other characteristics such as the Young's modulus in compression or the creep strength over time may also be taken into account.

Thus, in one embodiment, the description given with respect to the coefficient of thermal contraction applies by analogy to the modulus of elasticity of the areas of the tank wall. The first area 11 has a modulus of elasticity higher than the modulus of elasticity of the second area 12 and the transition area has a modulus of elasticity between the modulus of elasticity of the first area 11 and the modulus of elasticity of the second area 12. Moreover, the modulus of elasticity of the transition area 14 may decrease from the first area 11 toward the second area 12.

In any event, the insulating blocks 5, 7 of the transition area are selected such that the transition area 14 has an intermediate behavior in compression, between the behavior in compression of the first and second areas 11, 12, and such that the thickness of the transition area 14 is between the thickness of the first area 11 and the thickness of the second area 12 when the tank is full of LNG.

Such a transition area 14 allows a gentle transition between the first area 11 and the second area 12. To be specific, by virtue of the transition area 14, the step 13 between the first area 11 and the second area 12 is subdivided into a first step 15 and a second step 16 of reduced sizes. The first step 15 is located between the first area 11 and the transition area 14 and the second step 16 is located between the transition area 14 and the second area 12. The tank wall thus no longer has a large step 13 as shown in FIG. 1, which could be detrimental to the sealing membranes 2, 4, while having areas with resistance and insulation properties adapted to the stresses in tank. Steps 15, 16 of reduced sizes mean steps which are smaller in size than the step 13 between the first area 11 and the second area 12.

In FIGS. 3 to 18 and 20, the first area 11 comprises, in the primary insulating barrier 3 and in the secondary insulating barrier 1, structurally similar insulating blocks 5, 7. In these FIGS. 3 to 18 and 20, the second area 12 comprises, in the primary insulating barrier 3 and in the secondary insulating barrier 1, structurally similar insulating blocks 5, 7. For the sake of clarity of the figures, only one primary insulating block 7 and one secondary insulating block 5 of the first area 11 and of the second area 12 are shown in FIGS. 3 to 17 and 20, but the first area 11 and the second area 12 may include one or a plurality of juxtaposed primary 7 and secondary 5 insulating blocks, depending on the desired dimensions of said first area 11 and second area 12.

Figure 3:
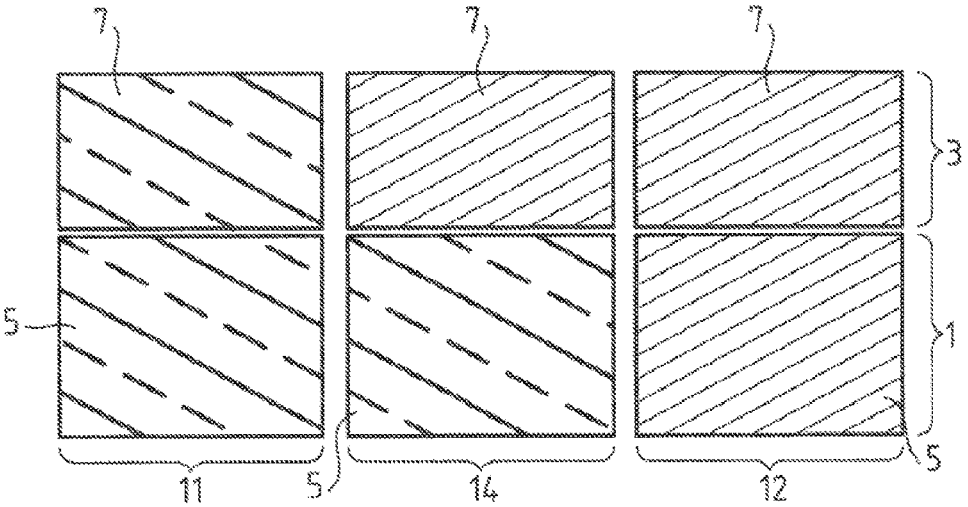
FIG. 3 schematically depicts a sealed and thermally insulating tank wall according to a first embodiment of the invention.

FIG. 3 shows a first embodiment of the transition area 14 in a tank wall. In this first embodiment, the transition area 14 includes a secondary insulating block 5 and a primary insulating block 7, which are superposed. The secondary insulating block 5 of the transition area 14 is identical to the secondary insulating blocks 5 of the first area 11. The primary insulating block 7 of the transition area 14 is identical to the primary insulating blocks 7 of the second area 12. Consequently, the coefficient of thermal contraction of the transition area 14 is the sum of the coefficients of thermal contraction of a secondary insulating block 5 of the first area 11 and of a primary insulating block 7 of the second area. Thus, the coefficient of thermal contraction of the transition area 14 is between the coefficient of thermal contraction of the first area 11 and the coefficient of thermal contraction of the second area 12.

This first embodiment has the advantage of being simple to produce since it uses standardized insulating blocks 5, 7 from the first area 11 and from the second area 12 to form the transition area 14. This first embodiment thus makes it possible to subdivide the step 13 of the primary support surface into two steps 15, 16 of reduced sizes.

According to an alternative (not shown) of the first embodiment, the primary insulating block 7 of the transition area 14 is identical to the primary insulating blocks 7 of the first area 11 and the secondary insulating block 5 of the transition area 14 is identical to the secondary insulating blocks 5 of the second area 12. This alternative which has not been shown also makes it possible to obtain a transition area 14 which is simple to produce by using insulating blocks 5, 7 identical to the insulating blocks 5, 7 of the first area 11 and of the second area 12 while providing a transition area 14 that subdivides the step 13 between the first area 11 and the second area 12 into steps 15, 16 which are acceptable for the primary sealing membrane 4.

Figure 4:
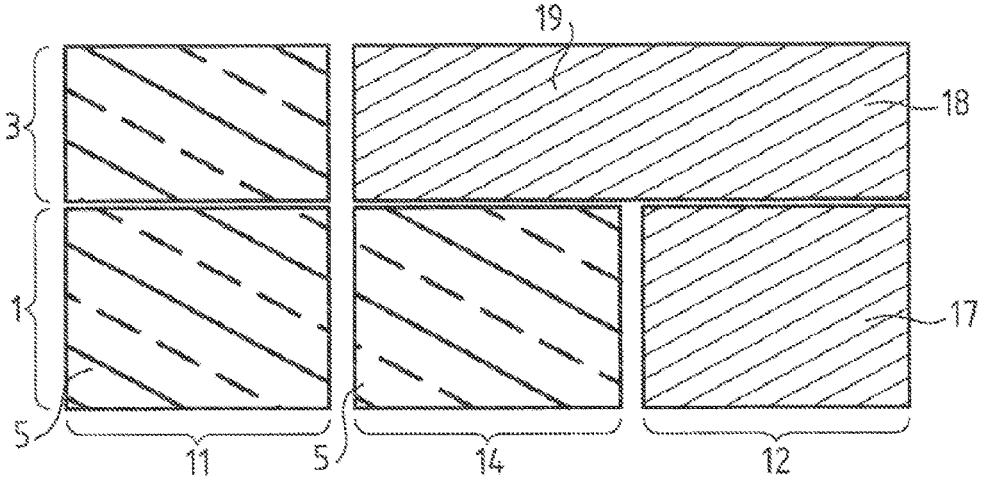
FIG. 4 schematically depicts a sealed and thermally insulating tank wall according to a second embodiment of the invention.

FIG. 4 shows a second embodiment of the transition area 14. In this second embodiment, the transition area 14 includes a secondary insulating block 5 identical to the secondary blocks 5 of the first area 11. However, the primary insulating barrier 3 of the transition area 14 is formed by a primary insulating block 7 extending jointly in the transition area 14 and in the second area 12.

A secondary end insulating block 17 of the second area 12 has a similar structure but with dimensions smaller than the other secondary insulating blocks 5 of the second area 12. Thus, a primary end insulating block 18 of the second area 12 resting on the secondary end insulating block 17 has a projecting portion 19 projecting toward the first area 11 beyond the secondary end insulating block 17. This projecting portion 18 rests on the secondary insulating block 5 of the transition area 14. In other words, this projecting portion 19 forms the primary insulating barrier 3 in the transition area 14.

In this second embodiment, the transition area 14 is thus made up, on the one hand, of the secondary insulating block 5 identical to the secondary insulating blocks 5 of the first area 11 and, on the other hand, of the projecting portion 19 of the primary end insulating block 17 of the second area 12. The transition area 14 therefore has a coefficient of thermal contraction identical to the coefficient of thermal contraction of the transition area 14 described with regard to the first embodiment of FIG. 3. However, in this second embodiment, the primary insulating barrier 3 does not have a step 16 between the transition area 14 and the second area 12. To be specific, this step 16 present in the first embodiment is advantageously absorbed by the primary end insulating block 18 which extends jointly in the transition area 14 and in the second area 12 and which has a flat support surface inclined between the transition area 14 and the second area 12.

Figure 5:
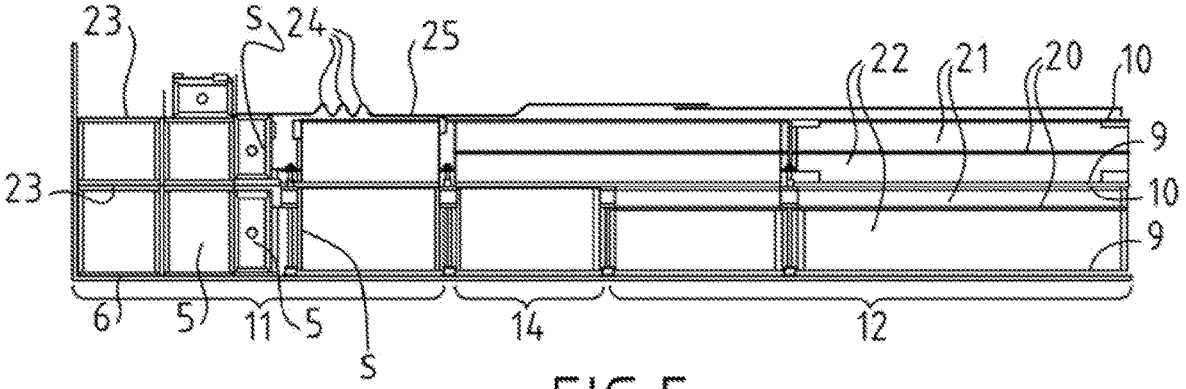
FIG. 5 depicts in detail the sealed and thermally insulating tank wall according to the second embodiment.

FIG. 5 shows a possible implementation of the second embodiment of FIG. 4.

In this figure, the first area 11 is a tank wall corner area. Such a tank corner is described in FR2798358 or WO2015007974, for example. This corner of the tank includes insulating blocks 5, 7 in the form of plywood boxes delimiting an internal space filled with an insulating lining such as perlite. Support spacers are in a distributed arrangement in the internal space of the boxes in order to provide the boxes with good stress resistance. As shown, the lateral sides of the boxes also form spacers S. Boxes of similar structure are used to make the primary thermally insulating barrier and for the secondary thermally insulating barrier.

The second area is made up of insulating blocks 5, 7 comprising an insulating lining 8 in the form of structural insulating foam arranged between the bottom plate 9 and the cover plate 10. These insulating blocks 5, 7 further comprise an intermediate plate 20 housed in the insulating lining 8, said insulating lining 8 thus comprising an upper insulating foam 21 arranged between the cover plate 10 and the intermediate plate 20 and a lower insulating foam 22 arranged between the intermediate plate 20 and the bottom plate 9. The upper insulating foam 21 and the lower insulating foam 22 are for example a polyurethane foam having a density of 130 kg/m$^3$. In the embodiment shown in FIG. 5, the secondary insulating block 5 of the second area 12 is for example a secondary insulating block as described in WO2014096600. In this FIG. 5, the primary insulating block 7 of the second area 12 is for example a primary insulating block as described in WO2013124556.

The secondary 2 and primary 4 sealing membranes are in this case produced by means of Invar strips with raised edges, for example with a dimension of 500 mm. The raised edges of two adjacent Invar strips are welded in pairs on welding supports anchored in the cover plate 10 of the insulating blocks 5, 7 forming the support surface on which said Invar strips rest. A connection ring has primary and secondary anchoring wings 23, one end of which is welded to the support structure 6 and the other end of which is welded to the end of the primary 4 and secondary 2 sealing membrane, respectively, so as to anchor said primary 4 and secondary 2 sealing membranes to the support structure 6. Such a connection ring is for example described in FR2798358, WO8909909 or WO2015007974.

In another embodiment, the connection ring is made up only of secondary anchoring wings 23, one end of which is welded to the support structure 6 and the other end of which is welded to the end of the secondary sealing membrane 2 so as to anchor said secondary sealing membrane 2 to the support structure 6.

In order to improve the absorption of the steps 15, 16 linked to the differences in structure of the insulating blocks 5, 7 between the different areas 11, 12, 14 of the tank wall, the primary sealing membrane 4 advantageously comprises a membrane portion with corrugations 24. Such corrugations 24 extend along the steps 15, 16. These corrugations 24 are for example produced by means of a corrugated metal sheet such as those described in FR2691520. This corrugated metal sheet is interposed between one end 25 of the Invar strips of the primary sealing membrane 4 and the primary anchoring wing 23 of the connection ring. Various metal parts (not shown) may also be interposed between the corrugated metal sheet and the primary anchoring wing 23, for example a corner angle iron forming the edge of the primary sealing membrane 4 at the corner of the tank.

FIG. 5 shows, by way of illustration, a first area 11 comprising, on the one hand, insulating blocks 5, 7 inside the connection ring and, on the other hand, a primary insulating block 7 and a secondary insulating block 5 outside the connection ring. This configuration is advantageous because the primary insulating block 7 and the secondary insulating block 5 of the first area 11 located outside of the connection ring help ensure good performance of the connection ring in the corner of the tank and of the welds between the connection ring and the membranes. However, this first area could include only the insulating blocks located inside the connection ring such that the transition area 14 would be directly adjacent to the connection ring.

Figure 6:
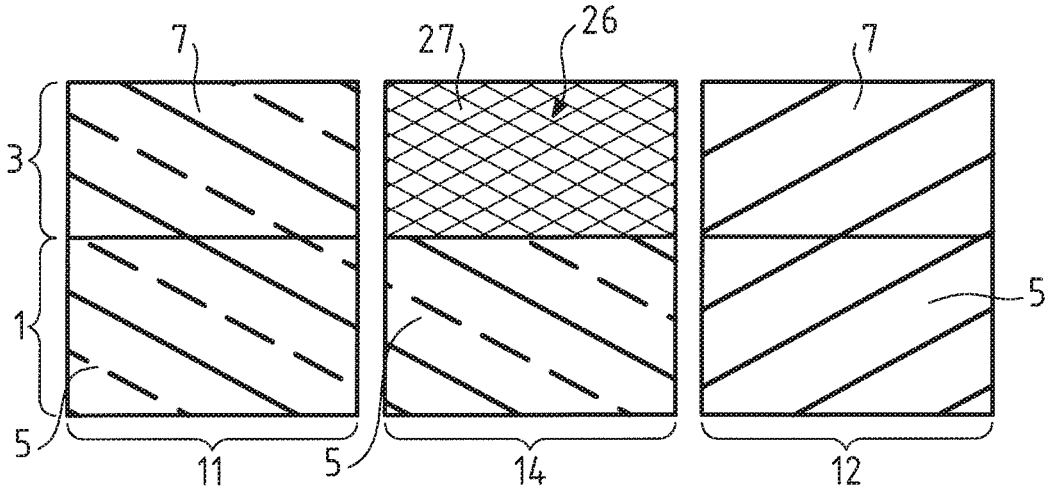
FIGS. 6 to 8 schematically depict sealed and thermally insulating tank walls according to alternative implementations of a third embodiment of the invention.
Figure 7:
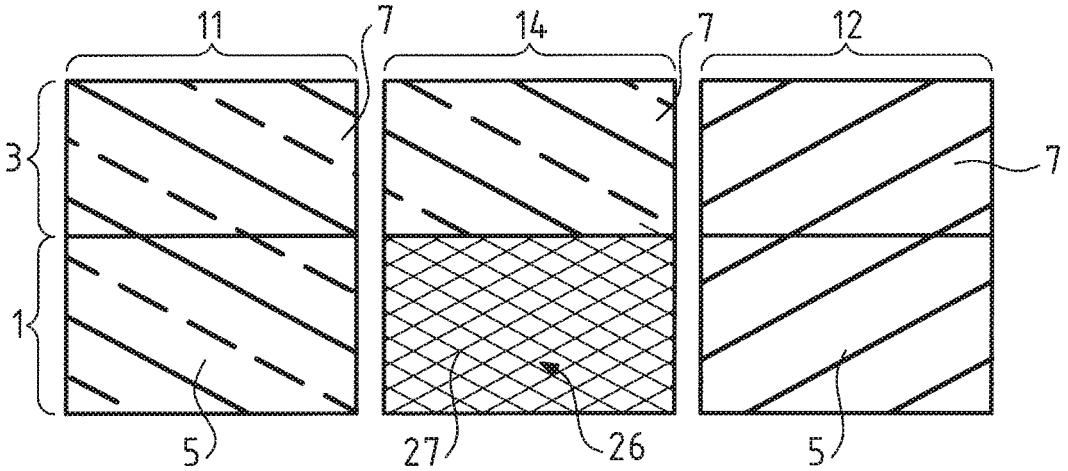
Figure 8:
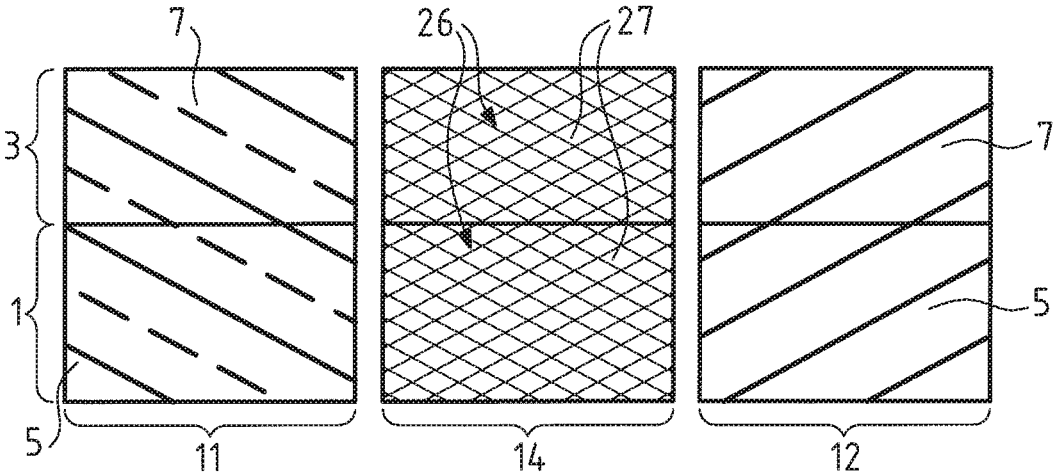

FIGS. 6 to 8 illustrate a third embodiment of the transition area 14. This third embodiment differs from the first embodiment in that the transition area 14 comprises at least one insulating block 26 which is different to the insulating blocks 5, 7 of the first area 11 and of the second area 12. This or these different insulating blocks 26 have a coefficient of thermal contraction which is between the coefficients of thermal contraction of the adjacent insulating blocks 5, 7 in the corresponding insulating barrier 1, 3.

Thus, in FIG. 6, the transition area 14 comprises a secondary insulating block 5 identical to the secondary insulating block 5 of the first area 11 and a different insulating block 26 arranged in the primary insulating barrier 1. This different insulating block 26 constitutes a primary insulating block 7 of the transition area 14 having a coefficient of thermal contraction which is between the coefficient of thermal contraction of the primary insulating blocks 7 of the first area 11 and of the second area 12.

Conversely, in FIG. 7, the transition area 14 comprises a primary insulating block 7 identical to the primary insulating blocks 7 of the second area 12 and a different insulating block 26 arranged in the secondary insulating barrier 1. This different insulating block 26 constitutes a secondary insulating block 5 of the transition area 14 having a coefficient of thermal contraction which is between the coefficient of thermal contraction of the secondary insulating blocks 5 of the first area 11 and of the second area 12.

In FIG. 8, the transition area 14 comprises two different insulating blocks 26, which are superposed. These different insulating blocks 26 constitute a primary insulating block 7 and a secondary insulating block 5 of the transition area, both having similar structures and a coefficient of thermal contraction which is between those of the adjacent insulating blocks 5, 7 of the first area 11 and of the second area 12.

The different insulating blocks 26 of the transition area 14 in this third embodiment are, for example, insulating blocks comprising a cover plate 10 and a bottom plate 9 kept at a distance by a different structural insulating foam 27, this different structural insulating foam 27 being different to the structural insulating foam of the insulating blocks 5, 7 of the second area 12. For example, the insulating blocks 5, 7 of the second area 12 may include a polyurethane foam having a density of 130 kg/m$^3$ whereas the different structural insulating foam 27 is a reinforced polyurethane foam which has a density of 210 kg/m$^3$. Thus, the transition area 14 has a coefficient of thermal contraction which is between the coefficient of thermal contraction of the first area 11 and the coefficient of thermal contraction of the second area 12.

Figure 9:
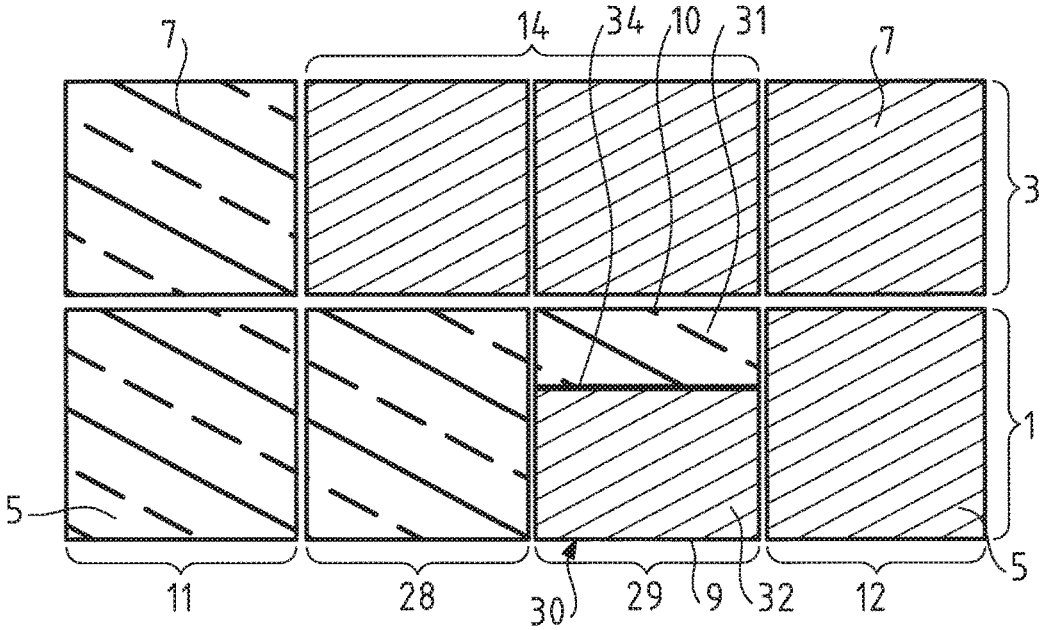
FIG. 9 schematically depicts a sealed and thermally insulating tank wall according to a fourth embodiment of the invention.

FIG. 9 shows a fourth embodiment of the transition area 14. In this fourth embodiment, the transition area 14 comprises a plurality of primary insulating blocks 7 and a plurality of secondary insulating blocks 5. This embodiment makes it possible to subdivide the transition area 14 into several sub-areas each having different coefficients of thermal contraction and therefore to subdivide the step 13 between the first area 11 and the second area 12 into a plurality of steps of reduced sizes. In this FIG. 9, the transition area 14 is divided into a first sub-area 28 and a second sub-area 29. The first sub-area 28 is contiguous with the first area 11 and the second sub-area 28 is contiguous with the second area 12.

The first sub-area 28 of the transition area 14 comprises a secondary insulating block 5 identical to the secondary insulating blocks 5 of the first area 11 and a primary insulating block 7 identical to the primary insulating blocks 7 of the second area 12. In other words, this first sub-area 28 is produced according to the first embodiment described above with reference to FIG. 3.

The second sub-area 29 of the transition area 14 comprises a primary insulating block 7 identical to the primary insulating blocks 7 of the second area 12. However, the secondary insulating block 5 of the second sub-area 29 is a mixed secondary insulating block 30. This mixed secondary insulating block 30 has a coefficient of thermal contraction which is between the coefficient of thermal contraction of the secondary insulating block 5 of the first area 11 and the coefficient of thermal contraction of the secondary insulating block 5 of the second area 12. Thus, the second sub-area 29 has a coefficient of thermal contraction which is between the coefficient of thermal contraction of the first sub-area 28 and the coefficient of thermal contraction of the second area 12. Consequently, the step 14 between the first area 11 and the second area 12 is subdivided into a first step separating the first area 11 and the first sub-area 28, a second step separating the first sub-area 28 and the second sub-area 29 and a third step separating the second sub-area 29 and the second area 12.

In order to have a suitable coefficient of thermal contraction, the mixed secondary insulating block 30 comprises an upper element 31 and a lower element 32 superposed in the thickness direction. The mixed secondary insulating block 30 comprises for example a lower element 32 formed by the bottom plate 9 and a lower structural insulating lining 33 and an upper element 31 formed by an insulating box. Such an insulating box comprises an intermediate plate 34 and the cover plate 10 kept at a distance by support spacers in a similar manner to the insulating blocks 5, 7 of the first area 11.

Other implementations may be employed to obtain a mixed secondary insulating block 30 with a coefficient of thermal contraction between the coefficient of thermal contraction of the secondary insulating blocks 5 of the first area 11 and of the second area 12. According to one embodiment, the upper element 31 may be produced by means of a structural insulating foam having a density greater than the density of the structural insulating foam of the secondary insulating blocks 5 of the second area 12. In another embodiment, the lower element 32 is a box and the upper element 31 comprises a structural insulating foam. In one embodiment, the respective thicknesses of the upper element 31 and of the lower element 32 are adapted to the coefficient of thermal contraction desired for the mixed secondary insulating block 30.

Figure 10:
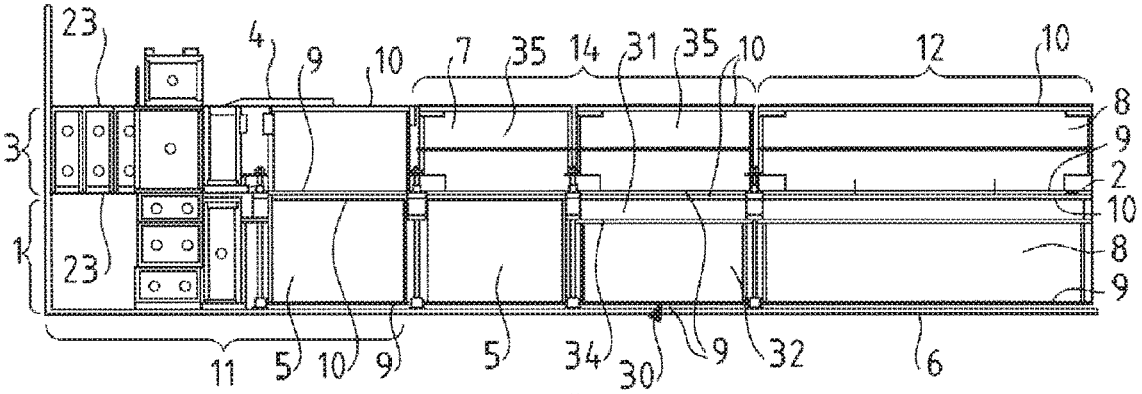
FIG. 10 depicts in detail the sealed and thermally insulating tank wall according to the fourth embodiment.

FIG. 10 shows an implementation of the fourth embodiment of FIG. 9. According to this implementation, the first area 11 and the second area 12 are produced in a similar manner to the first and second areas 11, 12 described above with reference to FIG. 5.

The first sub-area 28 of the transition area 14 comprises a secondary insulating block 5 in the form of a box identical to the secondary insulating blocks 5 of the first area 11. The primary insulating block 7 of the first sub-area 28 comprises a high density reinforced polyurethane foam 35 having a density greater than the density of the structural insulating foam of the primary insulating blocks 7 of the second area 12 such that the first sub-area 28 of the transition area 14 has a coefficient of thermal contraction higher than the coefficient of thermal contraction of the first area 11 but lower than the coefficient of thermal contraction of the second area 12. The primary insulating block 7 of the transition area 14 may further include an intermediate plate 20 housed in the high density reinforced polyurethane foam 35, said high density reinforced polyurethane foam 35 thus being arranged between the cover plate 10 and the intermediate plate 20 and between the intermediate plate 20 and the bottom plate 9.

The second sub-area 29 of the transition area 14 comprises a mixed secondary insulating block 30. This second sub-area 29 comprises a primary insulating block 7 identical to the primary insulating block 7 of the first sub-area 28. The mixed secondary insulating block 30 has a lower element 32 made of structural insulating foam identical to the structural insulating foam of the secondary insulating blocks 5 of the second area 12. The upper element 31 of the mixed secondary insulating block 30 is a box having a structure similar to the structure of the secondary insulating blocks 5 of the first area 11. Thus, the mixed secondary insulating block 30 has a coefficient of thermal contraction which is between the coefficient of thermal contraction of the secondary insulating block 5 of the first sub-area 28 and the coefficient of thermal contraction of the secondary insulating blocks 5 of the second area 12. Consequently, the second sub-area 29 of the transition area 14 has a coefficient of thermal contraction which is between the coefficient of thermal contraction of the first sub-area 28 of the transition area 14 and the coefficient of thermal contraction of the second area 12.

Figure 11:
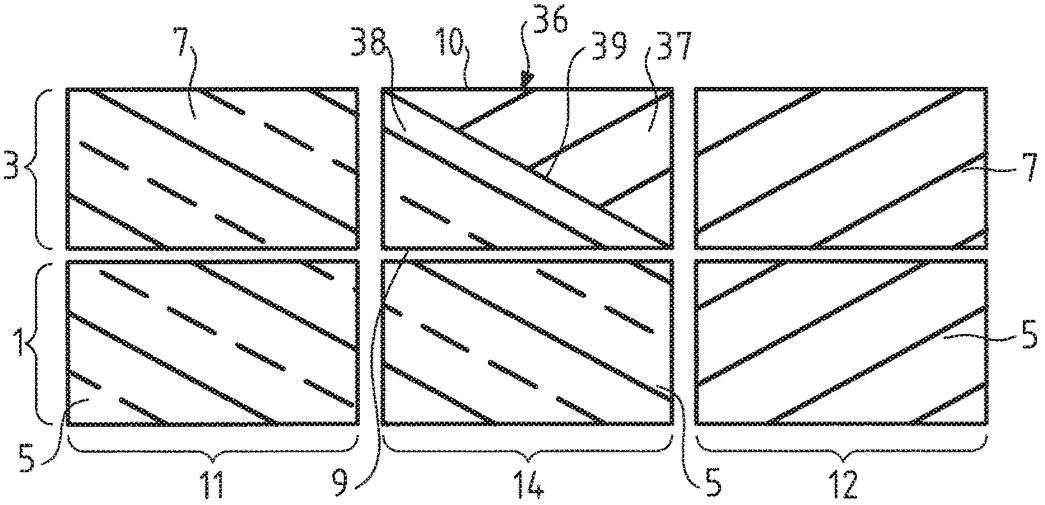
FIGS. 11 and 12 schematically depict sealed and thermally insulating tank walls according to alternative implementations of a fifth embodiment of the invention.
Figure 12:
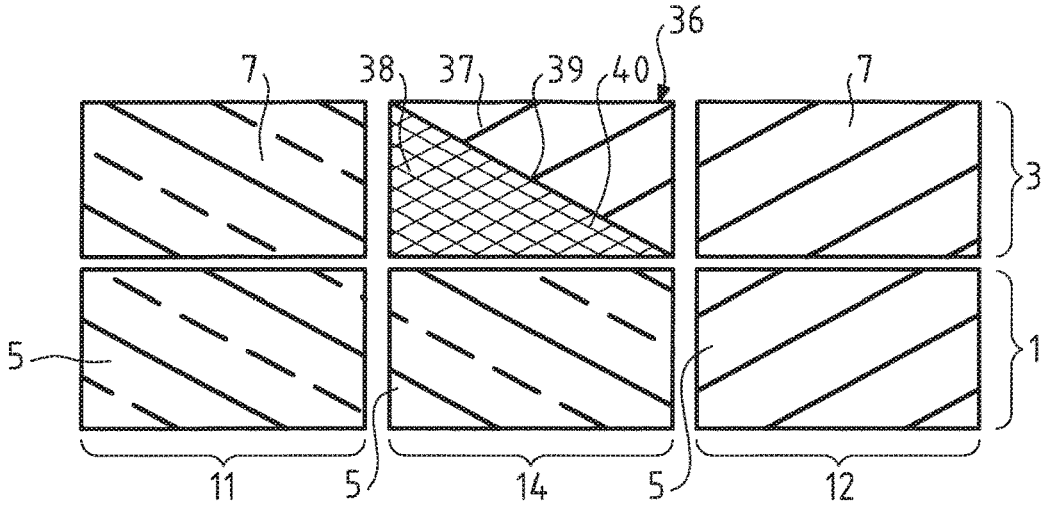

FIGS. 11 and 12 schematically show a fifth embodiment of the transition area 14. In this fifth embodiment, the secondary insulating block 5 of the transition area 14 is identical to the secondary insulating block 5 of the first area 11. The primary insulating block 7 of the transition area 14 is a mixed primary insulating block 36. Like the mixed secondary insulating block 30, this mixed primary insulating block 36 comprises an upper element 37 and a lower element 38 which are superposed and have different structures and coefficients of thermal contraction. However, the mixed primary insulating block 36 of the fifth embodiment differs from the mixed secondary insulating block 30 of the fourth embodiment in that the interface between the lower element 38 and the upper element 37 of said mixed primary insulating block 36 is inclined with respect to the bottom 9 and cover 10 plates. In other words, the lower element 38 of the mixed primary insulating block 36 has a thickness which gradually decreases from the first area 11 toward the second area 12 and the upper element 37 has a thickness which gradually increases from the first area 11 toward the second area 12. Moreover, the coefficient of thermal contraction of the lower element 38 is lower than the coefficient of thermal contraction of the upper element 37 such that the coefficient of thermal contraction of the mixed primary insulating block 36 gradually increases from the first area 11 toward the second area 12.

This fifth embodiment advantageously makes it possible to reduce the steps between the transition area 14 and the first and second areas 11, 12, the mixed primary insulating block 36 absorbing part of the thickness differential between the first area 11 and the second area 12 as it deforms owing to the gradual change in its coefficient of thermal contraction.

In an embodiment which is not shown, the inclination of the interface is reversed such that the thickness of the upper element 37 gradually decreases from the first area 11 toward the second area 12 and the thickness of the lower element 38 gradually increases from the first area 11 toward the second area 12. In this embodiment which is not shown, the coefficient of thermal contraction of the upper element 37 is lower than the coefficient of thermal contraction of the lower element 38.

The upper 37 and lower 38 elements are dimensioned such that the thickness of the mixed primary insulating block 36 is constant at ambient temperature in the tank.

In a first alternative shown in FIG. 11, the lower element 38 is a box delimited in a thickness direction of the tank wall by the bottom plate 9 of the mixed primary insulating block 36 and by an intermediate plate 39. The intermediate plate 39 is inclined relative to the bottom plate 9 such that the thickness of said box decreases from the first area 11 toward the second area 12. This box has support spacers keeping the bottom plate 9 of the mixed primary insulating block 36 and the intermediate plate 39 at a distance.

The upper element 37 comprises a structural insulating foam interposed between the intermediate plate 39 and the cover plate 10 of the mixed primary insulating element 36. In FIG. 11, this structural insulating foam is identical to the structural insulating foam of the primary insulating blocks 7 of the second area 12.

Thus, the mixed primary insulating block 36 has a coefficient of thermal contraction gradually increasing from the first area 11 toward the second area 12. More particularly, the coefficient of thermal contraction of the mixed primary insulating block 36 is identical to the coefficient of thermal contraction of a primary insulating block 7 of the first area 11 on the side of said first area 11 and gradually increases toward the second area 12 until it substantially reaches the value of the coefficient of thermal contraction of a primary insulating block 7 of the second area 12.

In another alternative shown in FIG. 12, the lower element 38 of the mixed primary insulating block 36 has a coefficient of thermal contraction which is between the coefficient of thermal contraction of the primary insulating blocks 7 of the first area 11 and the coefficient of thermal contraction of the primary insulating blocks 7 of the second area 12. For example, the lower element 38 is formed by means of a high density structural insulating foam 40 having a coefficient of thermal contraction which is lower than the coefficient of thermal contraction of the structural insulating foam of the primary insulating blocks 7 of the second area 12. The upper element 37 of said mixed primary insulating block 36 is in this alternative identical to the upper element 37 of the mixed primary insulating block 36 described with reference to FIG. 11, that is to say with a structural insulating foam identical to the structural insulating foam of the second area 12.

In an alternative which is not shown, the lower element 38 of the mixed primary insulating block 36 is a box as described above with reference to FIG. 11 and the upper element 37 of said mixed insulating block 36 comprises a structural insulating foam with a density greater than the density of the structural insulating foam of the primary insulating blocks 7 of the second area 12.

Figure 13:
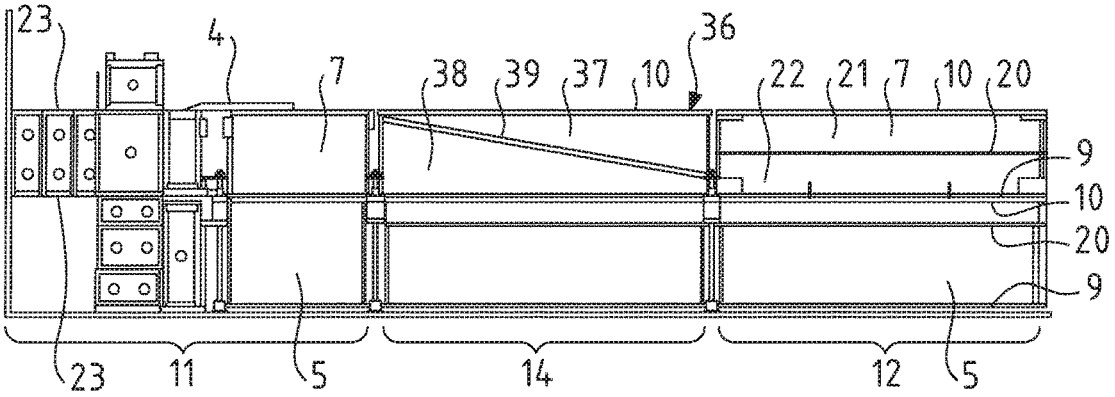
FIG. 13 depicts in detail the sealed and thermally insulating tank wall according to the fifth embodiment.
Figure 14:
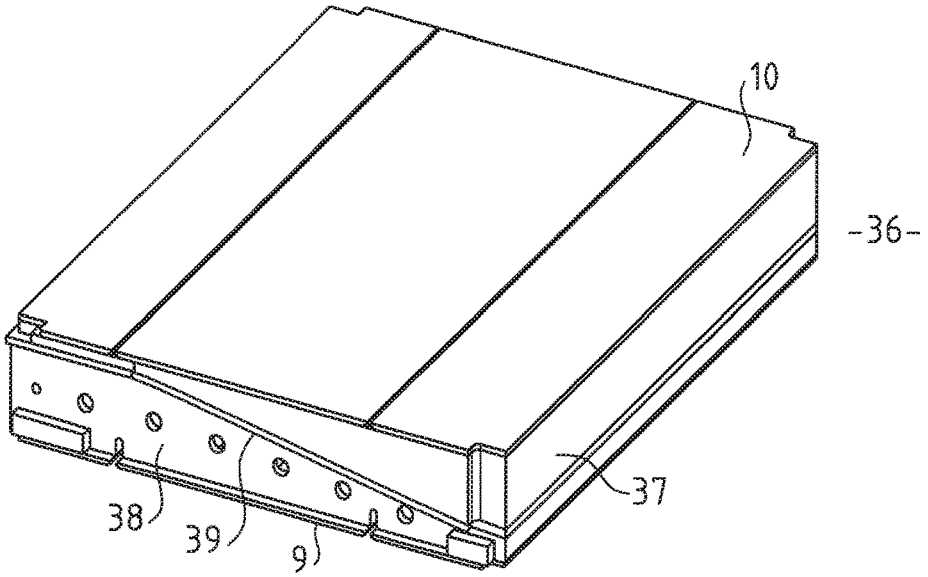
FIG. 14 shows an insulating module of the transition area of FIG. 13.

FIG. 13 shows an implementation of the fifth embodiment of either of FIG. 11 or 12. FIG. 14 shows an insulating module of the transition area of FIG. 13.

Figure 15:
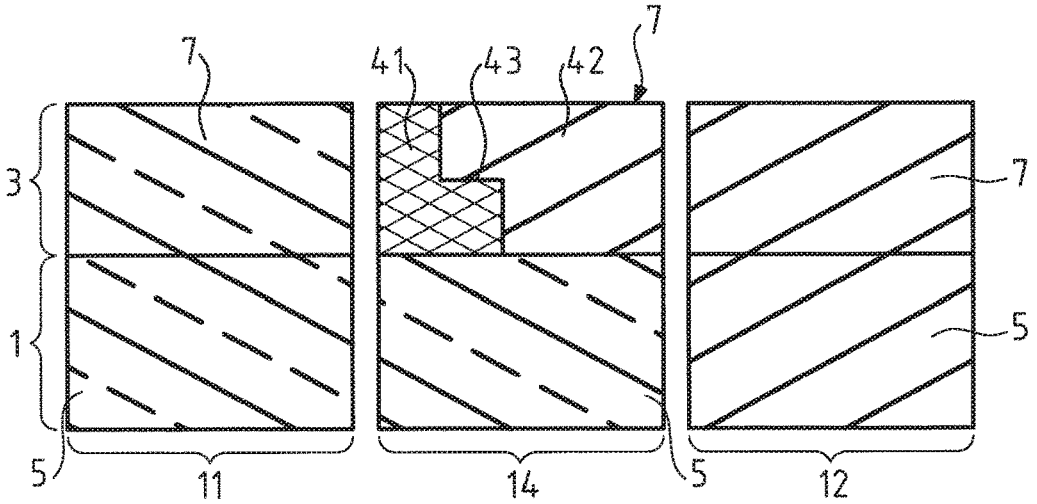
FIG. 15 schematically depicts a sealed and thermally insulating tank wall according to a sixth embodiment of the invention.

FIG. 15 schematically shows a sixth embodiment of the transition area 14. Like the mixed primary insulating block 36 of the fifth embodiment, the primary insulating block 7 of the transition area 14 in this sixth embodiment has a coefficient of thermal contraction which gradually decreases from the first area 11 toward the second area 12. However, in this sixth embodiment, the gradual decrease in the coefficient of thermal contraction of the primary insulating block 7 of the transition area 14 is achieved by the use of blocks of structural foam having different coefficients of thermal contraction in said primary insulating block 7.

Thus, the primary insulating block 7 of the transition area comprises a structural insulating foam keeping the bottom plate 9 and the cover plate 10 at a distance. This structural insulating foam has two portions, a first portion 41 located close to the first area 11 and a second portion 42 located close to the second area 12. The interface between the first portion 41 and the second portion 42 has at least one step 43 in the thickness direction of the primary insulating block 7 of the transition area 14. This step 43 allows a gradual decrease in the thickness of the first portion 41 and a gradual increase in the thickness of the second portion 42 from the first area 11 toward the second area 12.

The first portion 41 of structural insulating foam has a coefficient of thermal contraction which is lower than the coefficient of thermal contraction of the second portion 42. Thus, the primary insulating block 7 of the transition area 14 has a coefficient of thermal contraction increasing from the first area 11 toward the second area 12.

Figure 16:
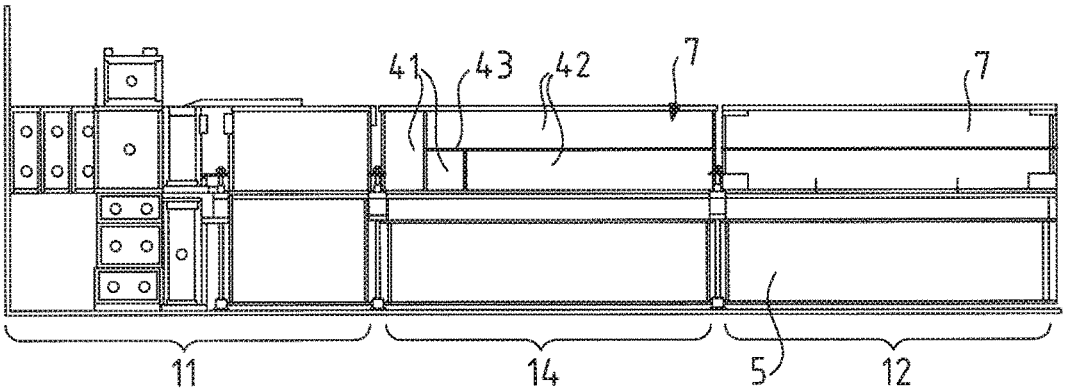
FIG. 16 depicts in detail the sealed and thermally insulating tank wall according to the sixth embodiment.
Figure 17:
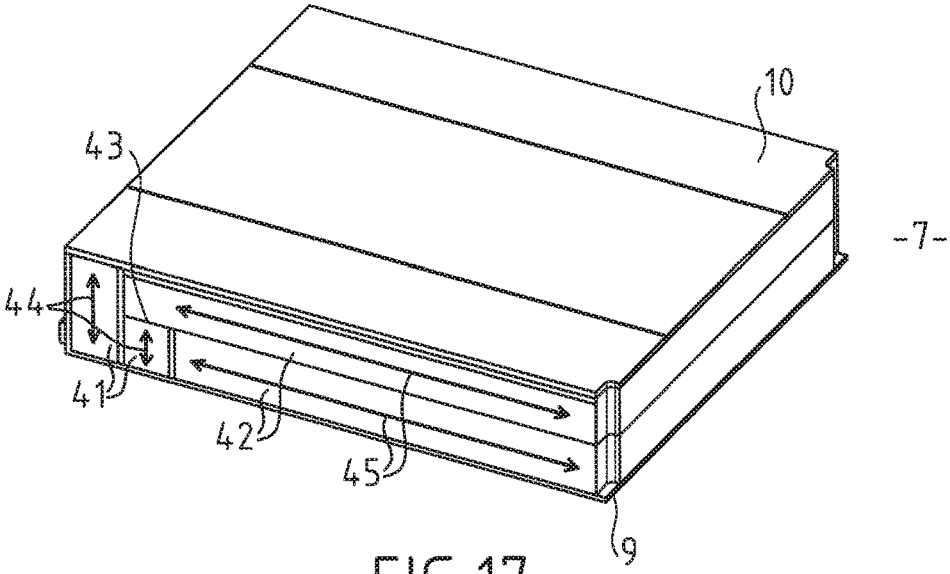
FIG. 17 shows an insulating module of the transition area of FIG. 16.

FIG. 16 shows an implementation of the sixth embodiment of FIG. 15. FIG. 17 shows an insulating module of the transition area of FIG. 15. In these figures, the first portion 41 and the second portion 42 are produced using a polyurethane foam reinforced by the presence of fibers such as glass fibers. However, the polyurethane foam of the first portion 41 is arranged such that the fibers are oriented in the thickness direction of the primary insulating block 7, as shown by the arrows 44. The polyurethane foam of the second portion 42 is arranged in such a way that the fibers are oriented in a direction perpendicular to the thickness direction of the primary insulating block 7, as shown by the arrows 45. Such an arrangement is similar to steps of a staircase formed by the first portion 41 and the second portion 42.

This difference in orientation of the fibers between the first portion 41 and the second portion 42 makes it possible to obtain a different coefficient of thermal contraction between the first portion 41 and the second portion 42 even though the polyurethane foam used to produce these two portions 41 and 42 is the same. Thus, the first portion 41 made of polyurethane foam, with fibers oriented in the thickness direction of the primary insulating block 7, has for example a coefficient of thermal contraction of the order of $25\times10^{-6}$ $K^{-1}$ to $27\times10^{-6}$ $K^{-1}$ for 10% by mass of glass fiber, while the second portion 42, made of polyurethane foam with fibers oriented perpendicular to the thickness of the primary insulating block 7, has for example a coefficient of thermal contraction of the order $60\times10^{-6}$ $K^{-1}$.

Another method for obtaining coefficients of thermal contraction between the first portion 41 and the second portion 42 could be to modify the content of fibers and their nature in the polyurethane foam to set the coefficient of thermal contraction at between 15 and $60\times10^{-6}$ $K^{-1}$.

Figure 18:
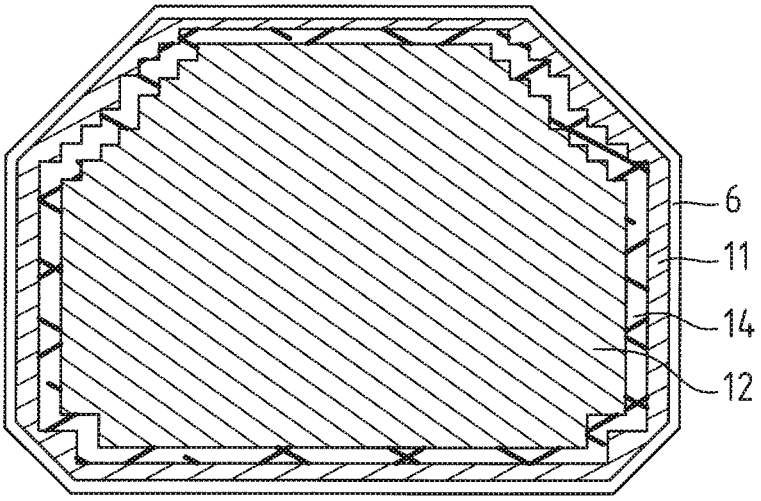
FIG. 18 schematically depicts a transverse wall of a sealed and thermally insulating tank comprising a first area, a transition area and a second area according to the invention.

In one embodiment, the first area 11 is arranged along all the edges of the tank walls, the second area 12 over all the central portions of the tank walls and the transition area 14 between all the first and second areas 11, 12 of the tank walls. FIG. 18 schematically shows a transverse wall of a sealed and thermally insulating tank comprising a first area, a transition area and a second area according to the invention arranged according to this embodiment.

Figure 20:
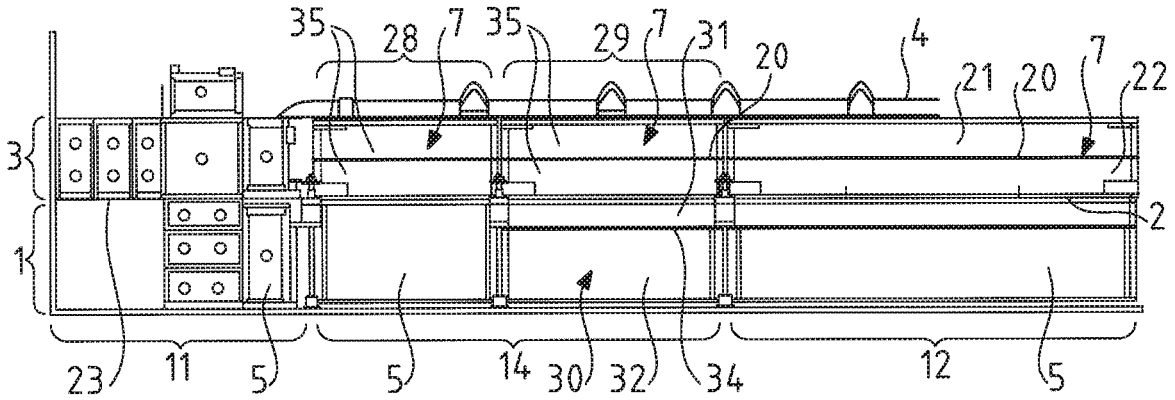
FIG. 20 depicts in detail the sealed and thermally insulating tank wall according to a seventh embodiment.

FIG. 20 shows the sealed and thermally insulating tank wall according to a seventh embodiment.

In the embodiment shown in FIG. 20, the first area 11 is a tank wall corner area comprising insulating blocks 5, 7 in the form of plywood boxes delimiting an internal space filled with an insulating lining such as perlite or glass wool. Support spacers are in a distributed arrangement in the internal space of the boxes in order to provide the boxes with good stress resistance. The first area 11 is therefore located at the connection ring and insulating blocks 5, 7 are located inside the connection ring.

The second area 12 is made up of insulating blocks 5, 7 comprising an insulating lining 8 in the form of structural insulating foam arranged between the bottom plate 9 and the cover plate 10. These insulating blocks 5, 7 further comprise an intermediate plate 20 housed in the insulating lining 8, said insulating lining 8 thus comprising an upper insulating foam 21 arranged between the cover plate 10 and the intermediate plate 20 and a lower insulating foam 22 arranged between the intermediate plate 20 and the bottom plate 9. The upper insulating foam 21 and the lower insulating foam 22 are for example a polyurethane foam having a density of 130 $kg/m^3$. In the embodiment shown in FIG. 5, the secondary insulating block 5 of the second area 12 is for example a secondary insulating block as described in WO2014096600. In this FIG. 5, the primary insulating block 7 of the second area 12 is for example a primary insulating block as described in WO2013124556.

The first sub-area 28 of the transition area 14 comprises a secondary insulating block 5 in the form of a box identical to the secondary insulating blocks 5 of the first area 11. The primary insulating block 7 of the first sub-area 28 comprises a high density reinforced polyurethane foam 35 having a density greater than the density of the structural insulating foam of the primary insulating blocks 7 of the second area 12 such that the first sub-area 28 of the transition area 14 has a coefficient of thermal contraction higher than the coefficient of thermal contraction of the first area 11 but lower than the coefficient of thermal contraction of the second area 12. The primary insulating block 7 of the transition area 14 includes in this embodiment an intermediate plate 20 housed in the high density reinforced polyurethane foam 35, said high density reinforced polyurethane foam 35 thus being arranged between the cover plate 10 and the intermediate plate 20 and between the intermediate plate 20 and the bottom plate 9.

The second sub-area 29 of the transition area 14 comprises a mixed secondary insulating block 30. This second sub-area 29 comprises a primary insulating block 7 identical to the primary insulating block 7 of the first sub-area 28. The mixed secondary insulating block 30 has a lower element 32 made of structural insulating foam identical to the structural insulating foam of the secondary insulating blocks 5 of the second area 12. The upper element 31 of the mixed secondary insulating block 30 is a box having a structure similar to the structure of the secondary insulating blocks 5 of the first area 11. Thus, the mixed secondary insulating block 30 has a coefficient of thermal contraction which is between the coefficient of thermal contraction of the secondary insulating block 5 of the first sub-area 28 and the coefficient of thermal contraction of the secondary insulating blocks 5 of the second area 12. Consequently, the second sub-area 29 of the transition area 14 has a coefficient of thermal contraction which is between the coefficient of thermal contraction of the first sub-area 28 of the transition area 14 and the coefficient of thermal contraction of the second area 12.

As shown in FIG. 20, the primary sealed membrane 4 is composed of corrugated metal plates. These corrugated metal plates are for example made of stainless steel with a thickness of approximately 1.2 mm and measuring 3 m×1 m. The metal plate of rectangular shape comprises a first series of parallel corrugations, referred to as low corrugations, extending in a direction y from one edge of the sheet to the other, and a second series of parallel corrugations, referred to as high corrugations, extending in a direction x from one edge of the metal sheet to the other. The directions x and y of the series of corrugations are perpendicular. The corrugations project, for example, from same side as the internal face of the metal sheet 1 which is intended to be brought into contact with the fluid contained in the tank. The edges of the metal plate are in this case parallel to the corrugations. Note that the terms "high" and "low" have a relative meaning and mean that the "low" corrugations have a smaller height than the "high" corrugations. Alternatively, the corrugations may have the same height.

The metal plate has a plurality of flat surfaces between the corrugations. Some of the corrugations may be located between the insulating blocks 7 or be on the flat parts of the insulating blocks 7. At each intersection between a low corrugation and a high corrugation, the metal plate has a node area. The node area has a central portion having an apex projecting inward or outward from the tank. Furthermore, the central portion is bordered, on the one hand, by a pair of concave corrugations formed in the crest of the high corrugation and, on the other hand, by a pair of recesses 8 in which the low corrugation enters.

A primary sealed membrane has been described above in which the corrugations are continuous at the intersections between the two series of corrugations. The primary sealed membrane may also have two series of mutually perpendicular corrugations with some corrugations being interrupted at the intersections between the two series. For example, the interruptions are distributed alternately in the first series of corrugations and the second series of corrugations and, within a series of corrugations, the interruptions in one corrugation are offset by one corrugation pitch relative to the interruptions in an adjacent parallel corrugation.

Since this type of sealed membrane composed of corrugated sheets is less sensitive to the phenomenon of steps during the thermal contraction of the thermally insulating barriers 1, 3 and more resistant to stresses, it is not necessary, as in the embodiment of FIG. 10, to place a primary insulating block 7 and a secondary insulating block 5 outside the connection ring in the first area. Thus, the first area 11 is made up only of the insulating blocks 5, 7 inside the connection ring. The transition area 14 is then directly adjacent to the connection ring.

In an embodiment which is not shown, the first area 11 may also be a gas dome, a gas dome, or an area for attaching a support stand for a pump. For example, in the case of the area for attaching a support stand for a pump, the first area 11 then surrounds the support stand and the secondary membrane 2 is attached to an anchoring wing 23 of the attachment area. The transition area 14 then extends all around the first area 11.

The technique described above for producing a tank may be used in different types of storage tanks, for example to build an LNG storage tank in an onshore facility or on a floating structure such as an LNG carrier or the like.

Figure 19:
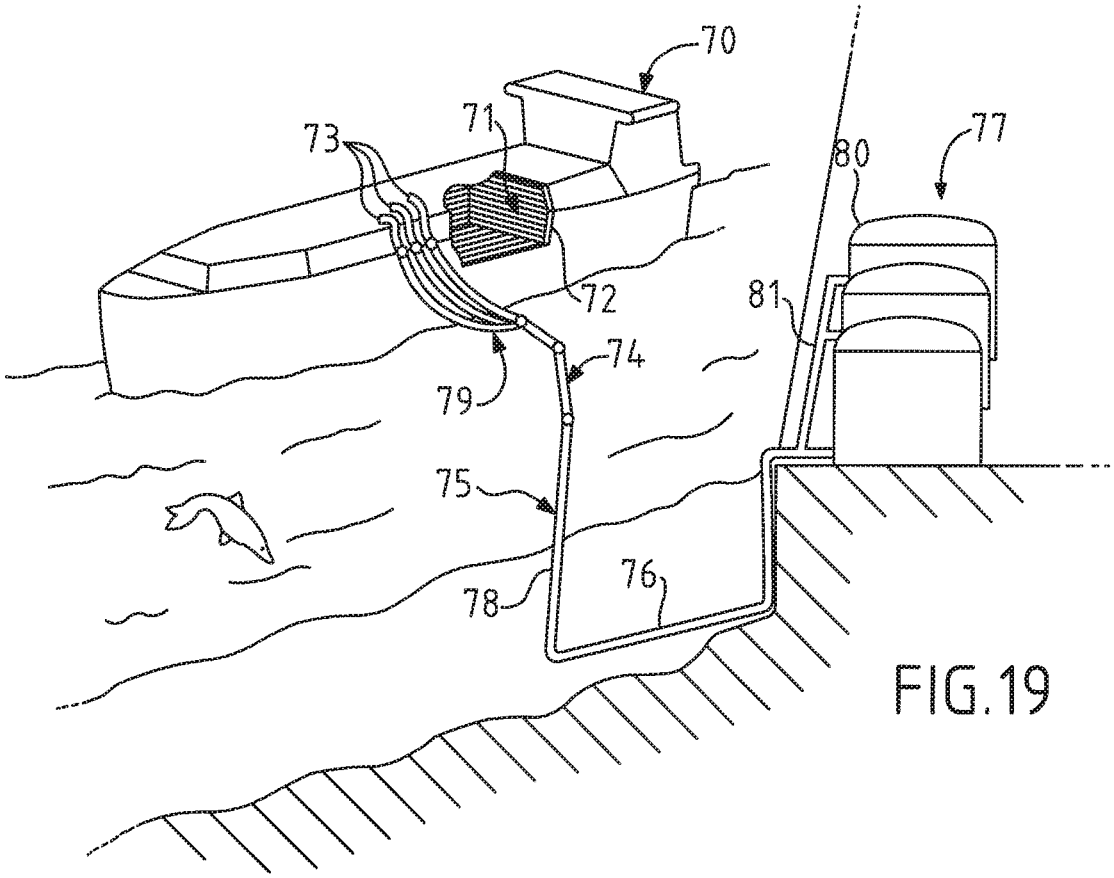
FIG. 19 schematically depicts, with part cut away, a tank of an LNG carrier and a loading/unloading terminal for this tank.

With reference to FIG. 19, a view of an LNG carrier 70 with part cut away shows a sealed and insulated tank 71 of generally prismatic shape mounted in the double hull 72 of the carrier. The wall of the tank 71 comprises a primary sealed barrier intended to be in contact with the LNG contained in the tank, a secondary sealed barrier arranged between the primary sealed barrier and the double hull 72 of the carrier, and two insulating barriers arranged respectively between the primary sealed barrier and the secondary sealed barrier and between the secondary sealed barrier and the double hull 72.

In a manner known per se, loading/unloading pipelines 73 arranged on the upper deck of the carrier may be connected, by means of appropriate connectors, to a maritime or port terminal for transferring a cargo of LNG from or to the tank 71.

FIG. 19 shows an example of a maritime terminal comprising a loading and unloading station 75, an underwater pipe 76 and an onshore facility 77. The loading and unloading station 75 is a fixed offshore facility comprising a movable arm 74 and a tower 78 which supports the movable arm 74. The movable arm 74 carries a bundle of insulated flexible pipes 79 which may be connected to the loading/unloading pipelines 73. The orientable movable arm 74 may be adjusted to suit all sizes of LNG carrier. A connecting pipe (not shown) extends inside the tower 78. The loading and unloading station 75 allows loading and unloading of the LNG carrier 70 from or to the onshore facility 77. This facility comprises tanks 80 for storing liquefied gas and connection pipes 81 connected by the underwater pipe 76 to the loading or unloading station 75. The underwater pipe 76 allows the transfer of the liquefied gas between the loading or unloading station 75 and the onshore facility 77 over a long distance, for example 5 km, which makes it possible to keep the LNG carrier 70 at a long distance from the shore during loading and unloading operations.

To generate the pressure necessary to transfer the liquefied gas, use is made of pumps on board the carrier 70 and/or pumps fitted to the onshore facility 77 and/or pumps fitted to the loading and unloading station 75.

Although the invention has been described in connection with several particular embodiments, it is obvious that it is in no way limited thereto and that it includes all technical equivalents of the means described as well as combinations thereof, if these fall within the scope of the invention.

Thus, the above examples present a tank wall comprising insulating barriers forming substantially flat support surfaces in an empty tank and having thickness differentials between various areas of the tank walls when the tank is loaded with LNG. However, the arrangement could be reversed such that the tank walls have thickness differentials in an empty tank and flat support surfaces when the tank is loaded with LNG.

Furthermore, the exemplary embodiments of the transition area described above may be combined with one another, for example in the context of a transition area comprising a plurality of primary 7 and secondary 5 insulating blocks so as to generate a plurality of sub-areas of the transition area 14 with coefficients of thermal contraction increasing from the first area 11 toward the second area 12.

The use of the verb "comprise" or "include" and conjugated forms thereof does not rule out the presence of other elements or other stages in addition to those stated in a claim. The use of the indefinite article "a" or "an" for an element or a stage does not rule out, unless otherwise stated, the presence of a plurality of such elements or stages.

In the claims, any reference sign in parentheses should not be interpreted as a limitation of the claim.

The invention claimed is:

1. A sealed and thermally insulating tank for storing a fluid, integrated in a support structure (6), in which a tank wall comprises, in a thickness direction:

a secondary thermally insulating barrier (1) and a primary thermally insulating barrier (3) made up of juxtaposed insulating modules (5, 7, 17, 18, 26, 30, 36), an insulating module (5, 7, 17, 18, 26, 30, 36) comprising a cover panel (10), a bottom panel (9) and an insulating lining (8) interposed between the bottom panel (9) and the cover panel (10), a primary sealed membrane (4) resting on the primary thermally insulating barrier (3), and a secondary sealed membrane (2) resting on the secondary thermally insulating barrier (1), the tank wall comprising, in a length direction:

a first area (11) in which the insulating modules (5, 7) include spacers extending in the thickness direction of the tank wall between the cover panel (10) and the bottom panel (9) of said insulating modules (5, 7), said spacers being distributed over the surface of the cover panel (10) and of the bottom panel (9) in such a way that the bottom panel (9) and the cover panel (10) of said insulating modules (5, 7) are kept at a distance from one another by said spacers, a second area (12) in which the insulating lining (8) of the insulating modules (5, 7) Comprises a structural insulating foam interposed between the cover panel (10) and the bottom panel (9) on the surface of the cover panel (10) and of the bottom panel (9) in such a way that the cover panel (10) of said insulating modules (5, 7) is kept at a distance from the bottom panel (9) by said structural insulating foam, a transition area (14) interposed between the first area (11) and the second area (12), in which the insulating modules (5, 7, 18, 26, 30, 36) are formed in such a way that the tank wall in said transition area (14) has at least one parameter, chosen from the coefficient of thermal contraction and the modulus of elasticity in the thickness direction of the tank wall, the value of which lies between the value of said at least one parameter of the first area (11) of the tank wall in the thickness direction of the tank wall and the value of said at least one parameter of the second area (12) of the tank wall in the thickness direction of the tank wall.

2. The sealed and thermally insulating tank as claimed in claim 1, in which the first area (11) is arranged over all or part of a periphery of the wall.

3. The sealed and thermally insulating tank as claimed in claim 1, in which the first area (11) is a corner area of the tank, a gas dome, a liquid dome or an area for attaching a support stand for a pump.

4. The sealed and thermally insulating tank as claimed in claim 1, in which the insulating modules (5, 7, 18, 26, 30, 36) of the transition area (14) comprise:

a first insulating module (5, 26, 30) arranged in the secondary thermally insulating barrier (1), the first insulating module (5, 26, 30) having a first value of said at least one parameter in the thickness direction of the tank wall, and a second insulating module (7, 18, 26, 36) arranged in the primary thermally insulating barrier, the second insulating module (7, 18, 26, 36) having a second value of said at least one parameter in the thickness direction of the tank wall, the first insulating module (5, 26, 30) and the second insulating module (7, 18, 26, 36) being superposed in the direction of the thickness of the tank wall.

5. The sealed and thermally insulating tank as claimed in claim 4, in which one out of the first insulating module (5, 30) and the second insulating module (7, 36) comprises spacers extending in a thickness direction of the tank wall between the cover panel (10) and the bottom panel (9) of said insulating module, said spacers being distributed over the surface of the bottom panel (9) and of the cover panel (10) in such a way that the bottom panel (9) and the cover panel (10) of said insulating module are kept at a distance from one another by said spacers, and the other out of the first insulating module (5, 26) and the second insulating module (7, 18, 26) comprises a structural insulating foam interposed between the cover panel (10) and the bottom panel (9) on the surface of the cover panel (10) and of the bottom panel (9) in such a way that the cover panel (10) of said other insulating module is kept at a distance from the bottom panel (9) of said other insulating module by said structural insulating foam.

6. The sealed and thermally insulating tank as claimed in claim 5, in which the value of said at least one parameter of the other out of the first insulating module (5, 26) and the second insulating module (7, 18, 26) is lower than the value of said at least one parameter of the one out of the first insulating module (5, 30) and the second insulating module (7, 36).

7. The sealed and thermally insulating tank as claimed in claim 4, in which the first area (11) corresponds to a corner area of the tank comprising a connection ring, and the transition area (14) is directly adjacent to the connection ring, the second insulating module (7, 18, 26) comprises a structural insulating foam interposed between the cover panel (10) and the bottom panel (9) on the surface of the cover panel (10) and of the bottom panel (9) in such a way that the cover panel (10) of said other insulating module is kept at a distance from the bottom panel (9) of said other insulating module by said structural insulating foam.

8. The sealed and thermally insulating tank as claimed in claim 7, in which the first insulating module comprises spacers extending in a thickness direction of the tank wall between the cover panel (10) and the bottom panel (9) of said insulating module, said spacers being distributed over the surface of the bottom panel (9) and of the cover panel (10) in such a way that the bottom panel (9) and the cover panel (10) of said insulating module are kept at a distance from one another by said spacers.

9. The sealed and thermally insulating tank as claimed in claim 7, in which the insulating modules (5, 7, 18, 26, 30, 36) of the transition area (14) comprise:

a third insulating module (26) arranged in the secondary thermally insulating barrier (1), the third insulating module being closer to the second area (12) than the first insulating module (5, 26, 30) and having a third value of said at least one parameter in the thickness direction of the tank wall, a fourth insulating module (7, 18, 26, 36) arranged in the primary thermally insulating barrier (3), the fourth insulating module (7, 18, 26, 36) being closer to the second area (12) than the second insulating module (7, 18, 26, 36) and having a fourth value of said at least one parameter in the thickness direction of the tank wall, and in which the third value of said at least one parameter of the third insulating module (26) is between the first value of said at least one parameter of the first insulating module (5, 26, 30) and the second value of said at least one parameter of the second insulating module (7, 18, 26, 36).

10. The sealed and thermally insulating tank as claimed in claim 9, in which the third insulating module (26) is a mixed module comprising an intermediate panel (20) arranged between the bottom panel and the cover panel, the insulating lining comprising a lower lining arranged between the intermediate panel and the bottom panel and an upper lining arranged between the intermediate panel and the cover panel, the mixed module having a coefficient of thermal expansion which is between the coefficient of thermal expansion of an insulating module of the first area (11) and the coefficient of thermal expansion of an insulating module of the second area (12).

11. The sealed and thermally insulating tank as claimed in claim 9, in which the fourth insulating module (7, 18, 26, 36) is identical to the second insulating module (7, 18, 26, 36), such that the fourth value of said at least one parameter is equal to the second value of said at least one parameter.

12. The sealed and thermally insulating tank as claimed in claim 4, in which the insulating modules (5, 7, 18, 26, 30, 36) of the transition area (14) comprise a third insulating module (26) arranged in the secondary thermally insulating barrier (1), the third insulating module being closer to the second area (12) than the first insulating module (5, 26, 30) and having a third value of said at least one parameter in the thickness direction of the tank wall, and in which the second insulating module (7, 18, 26) extends over the entire length of the transition area in the primary thermally insulating barrier (3), the third value of said at least one parameter of the third insulating module (26) being between the first value of the first insulating module (5, 26, 30) of said at least one parameter and the second value of said at least one parameter of the second insulating module (7, 18, 26, 36).

13. The sealed and thermally insulating tank as claimed in claim 5, in which said other out of the first insulating module and the second insulating module (18) extends jointly in the transition area (14) and in the second area (12) of the tank wall.

14. The sealed and thermally insulating tank as claimed in claim 1, in which the transition area (14) has a coefficient of thermal contraction in the thickness direction of the tank wall increasing in the length direction of the tank wall from the first area (11) toward the second area (12) of the tank wall.

15. The sealed and thermally insulating tank as claimed in claim 1, in which the transition area (14) has a modulus of elasticity in the thickness direction of the tank wall decreasing in the length direction of the tank wall from the first area (11) toward the second area (12) of the tank wall.

16. The sealed and thermally insulating tank as claimed in claim 14, in which the coefficient of thermal contraction in the thickness direction of the tank wall in the transition area (14) increases continuously and gradually from the first area (11) toward the second area (12).

17. The sealed and thermally insulating tank as claimed in claim 1, in which an insulating module (7, 26) of the transition area (14) comprises a structural insulating foam (27, 41, 42) interposed between the cover panel (10) and the bottom panel (9) on the surface of the cover panel (10) and of the bottom panel (9) of said insulating module (7, 26) in such a way that the cover panel (10) of said insulating module (7, 26) is kept at a distance from the bottom panel (9) of said insulating module by said structural insulating foam, (27, 41, 42), said structural insulating foam (27, 41) having a coefficient of thermal contraction in the thickness direction of the tank wall which is lower than the coefficient of thermal contraction in said thickness direction of the structural insulating foam of the second area (12).

18. The sealed and thermally insulating tank as claimed in claim 17, in which the structural insulating foam (41, 42) of said insulating module (7) of the transition area comprises a first portion (41) of structural insulating foam and a second portion (42) of structural insulating foam, the first portion (41) of structural insulating foam being closer to the first area (11) than the second portion (42) of structural foam, the first portion (41) of structural insulating foam having a coefficient of thermal contraction in the thickness direction of the tank which is lower than the coefficient of thermal contraction of the second portion (42) of structural insulating foam in said thickness direction.

19. The sealed and thermally insulating tank as claimed in claim 1, in which an insulating module (7, 26) of the transition area (14) comprises a structural insulating foam (27, 41, 42) interposed between the cover panel (10) and the bottom panel (9) on the surface of the cover panel (10) and of the bottom panel (9) of said insulating module (7, 26) in such a way that the cover panel (10) of said insulating module (7, 26) is kept at a distance from the bottom panel (9) of said insulating module by said structural insulating foam (27, 41, 42), said structural insulating foam (27, 41) having a modulus of elasticity in the thickness direction of the tank wall which is higher than the modulus of elasticity in said thickness direction of the structural insulating foam of the second area (12).

20. The sealed and thermally insulating tank as claimed in claim 19, in which the structural insulating foam (41, 42) of said insulating module (7) of the transition area comprises a first portion (41) of structural insulating foam and a second portion (42) of structural insulating foam, the first portion (41) of structural insulating foam being closer to the first area (11) than the second portion (42) of structural foam, the first portion (41) of structural insulating foam having a modulus of elasticity in the thickness direction of the tank which is higher than the modulus of elasticity of the second portion (42) of structural insulating foam in said thickness direction.

21. The sealed and thermally insulating tank as claimed in claim 17, in which the structural insulating foam (41, 42) of said module (7) of the transition area is a fiber-reinforced polyurethane foam, the first portion (41) of structural insulating foam having the fibers oriented in a thickness direction of the tank wall and the second portion (42) of structural insulating foam having the fibers oriented perpendicular to the thickness direction of the tank wall.

22. The sealed and thermally insulating tank as claimed in claim 15, in which the thickness of the first portion (41) gradually decreases from the first area (11) toward the second area (12) and the thickness of the second portion gradually increases from the first area (11) toward the second area (12).

23. The sealed and thermally insulating tank as claimed in claim 1, in which the insulating modules of the transition area comprise a mixed module (30, 36) comprising an intermediate panel (34, 39) arranged between the bottom panel (9) and the cover panel (10), the insulating lining (8) comprising a lower lining arranged between the intermediate panel (34, 39) and the bottom panel (9) and an upper lining arranged between the intermediate panel (34, 39) and the cover panel (10), the mixed module (30, 36) comprising support spacers extending in a thickness direction of the tank wall between the intermediate panel (34, 39) and one out of the bottom panel (9) and the cover panel (10), said spacers being distributed over the surface of the intermediate panel (34, 39) and of said one out of the bottom panel (9) and the cover panel (10) in such a way that the intermediate panel (34, 39) and said one out of the bottom panel (9) and the cover panel (10) are kept at a distance from one another by said support spacers, the insulating lining arranged between the intermediate panel (34, 39) and the other out of the bottom panel (9) and the cover panel (10) comprising a structural insulating foam distributed over the surface of the intermediate panel (34, 39) and of said other out of the bottom panel (9) and the cover panel (10) in such a way that the intermediate panel (34, 39) and said other out of the bottom panel (9) and the cover panel (10) are kept at a distance by said structural insulating foam.

24. The sealed and thermally insulating tank as claimed in claim 23, in the intermediate panel (39) extends in a plane which is inclined relative to the bottom panel (9) and to the cover panel (10).

25. The sealed and thermally insulating tank as claimed in claim 23, in which the intermediate panel (39) is at a distance from an edge of the mixed module (36) located close to one out of the first area (11) and the second area (12).

26. The sealed and thermally insulating tank as claimed in claim 1, in which the primary and secondary sealed membranes are made up essentially of metal strips extending in the length direction and having raised longitudinal edges, the raised edges of two adjacent metal strips being welded in pairs so as to form expansion bellows allowing deformation of the sealed membrane in a direction perpendicular to the length direction, in which the corner of the tank comprises a primary anchoring wing (23) and a secondary anchoring wing, a first end of said anchoring wings (23) being anchored to the support structure (6) and a second end of said anchoring wings (23) being leaktightly welded to the corresponding sealing membrane.

27. The sealed and thermally insulating tank as claimed in claim 26, in which the primary sealing membrane comprises corrugations extending perpendicular to the raised edges and arranged in line with the first area (11).

28. The sealed and thermally insulating tank as claimed in claim 1, in which the secondary sealed membrane (2) is made up essentially of metal strips extending in the length direction and having raised longitudinal edges, the raised edges of two adjacent metal strips being welded in pairs so as to form expansion bellows allowing deformation of the sealed membrane in a direction perpendicular to the length direction, in which the corner of the tank comprises a secondary anchoring wing (23), a first end of said anchoring wing (23) being anchored to the support structure (6) and a second end of said anchoring wing (23) being leaktightly welded to the secondary sealing membrane, and in which the primary sealed membrane (4) comprises corrugated metal plates.

29. A carrier (70) for the transport of a cold liquid product, the carrier comprising a double hull (72) and a tank (71) as claimed in claim 1, arranged in the double hull.

30. A method for loading or unloading a carrier (70) as claimed in claim 29, in which a cold liquid product is conveyed through insulated pipelines (73, 79, 76, 81) from or to a floating or onshore storage facility (77), to or from the tank of the carrier (71).

31. A transfer system for a cold liquid product, the system comprising a carrier (70) as claimed in claim 29, insulated pipelines (73, 79, 76, 81) arranged so as to connect the tank (71) installed in the hull of the carrier to a floating or onshore storage facility (77), and a pump for pumping a flow of cold liquid product through the insulated pipelines from or to the floating or onshore storage facility, to or from the tank of the carrier.

* * * * *